US009101036B2

(12) United States Patent
Guzan et al.

(10) Patent No.: US 9,101,036 B2
(45) Date of Patent: Aug. 4, 2015

(54) PHOTOLUMINESCENT NANOFIBER COMPOSITES, METHODS FOR FABRICATION, AND RELATED LIGHTING DEVICES

(75) Inventors: Kimberly A. Guzan, Clayton, NC (US); Karmann C. Mills, Apex, NC (US); Li Han, Apex, NC (US); James Lynn Davis, Holly Springs, NC (US); Paul G. Hoertz, Morrisville, NC (US)

(73) Assignee: Research Triangle Institute, Durham, NC (US)

( * ) Notice: Subject to any disclaimer, the term of this patent is extended or adjusted under 35 U.S.C. 154(b) by 214 days.

(21) Appl. No.: 13/817,896

(22) PCT Filed: Aug. 19, 2011

(86) PCT No.: PCT/US2011/048429

§ 371 (c)(1),
(2), (4) Date: May 8, 2013

(87) PCT Pub. No.: WO2012/024591

PCT Pub. Date: Feb. 23, 2012

(65) Prior Publication Data

US 2013/0215598 A1 Aug. 22, 2013

Related U.S. Application Data

(60) Provisional application No. 61/375,515, filed on Aug. 20, 2010.

(51) Int. Cl.
*H01J 1/62* (2006.01)
*H05B 33/14* (2006.01)
(Continued)

(52) U.S. Cl.
CPC ..... *H05B 33/145* (2013.01); *D06P 1/0012* (2013.01); *F21V 9/16* (2013.01); *H05B 33/14* (2013.01); *H05B 33/20* (2013.01); *Y10T 428/2481* (2015.01)

(58) Field of Classification Search
CPC ..... F21V 9/16
USPC ..... 313/501, 502, 503; 362/84
See application file for complete search history.

(56) References Cited

U.S. PATENT DOCUMENTS 4,853,594 A 8/1989 Thomas
5,892,621 A 4/1999 McGregor et al.
(Continued)

FOREIGN PATENT DOCUMENTS

AT DE102005030374 A1 1/2007
NL WO2008149250 A1 12/2008
(Continued)

OTHER PUBLICATIONS

International Preliminary Report on Patentability dated Mar. 7, 2013 for PCT/US2011/048415.
(Continued)

*Primary Examiner* — Vip Patel
(74) *Attorney, Agent, or Firm* — Olive Law Group; David P. Gloekler

(57) ABSTRACT

A photoluminescent nanofiber composite includes a nanofiber substrate, first luminescent particles, and second luminescent particles. The first luminescent particles are supported by the nanofibers and span at least a portion of a substrate surface, as a layer on the substrate surface, or with some particles located in a bulk of the substrate, or both. The second luminescent particles are disposed on the substrate. The second luminescent particles may be disposed directly on the substrate surface or on the first luminescent particles. The second luminescent particles may be deposited in a pattern of deposition units. The first and second luminescent particles are configured for emitting light of different respective wavelengths in response to excitation by a light beam. One or more surface treatment coatings may be provided at different locations.

32 Claims, 13 Drawing Sheets

(51) Int. Cl.

| | |
|---|---|
| ***D06P 1/00*** | (2006.01) |
| ***H05B 33/20*** | (2006.01) |
| ***F21V 9/16*** | (2006.01) |

(56) References Cited

U.S. PATENT DOCUMENTS

| | | | |
|---|---|---|---|
| 5,998,925 | A | 12/1999 | Shimizu et al. |
| 6,357,889 | B1 | 3/2002 | Duggal et al. |
| 6,465,951 | B1 | 10/2002 | Krafcik et al. |
| 6,641,287 | B2 | 11/2003 | Suehiro |
| 6,737,681 | B2 | 5/2004 | Koda |
| 7,070,300 | B2 | 7/2006 | Harbers et al. |
| 7,144,131 | B2 | 12/2006 | Rains |
| 7,311,858 | B2 | 12/2007 | Wang et al. |
| 7,390,437 | B2 | 6/2008 | Dong et al. |
| 7,614,759 | B2 | 11/2009 | Negley |
| 7,618,157 | B1 | 11/2009 | Galvez et al. |
| 7,660,040 | B2 | 2/2010 | Starry et al. |
| 7,703,943 | B2 | 4/2010 | Li et al. |
| 7,703,945 | B2 | 4/2010 | Leung et al. |
| 7,750,359 | B2 | 7/2010 | Narendran et al. |
| 7,942,540 | B2 | 5/2011 | Harbers et al. |
| 7,942,556 | B2 | 5/2011 | Harbers et al. |
| 2004/0245912 | A1 | 12/2004 | Thurk et al. |
| 2005/0224998 | A1 | 10/2005 | Andrady et al. |
| 2005/0224999 | A1 | 10/2005 | Andrady et al. |
| 2006/0072314 | A1 | 4/2006 | Rains |
| 2006/0145123 | A1 | 7/2006 | Li et al. |
| 2006/0158090 | A1 | 7/2006 | Wang et al. |
| 2006/0203468 | A1 | 9/2006 | Beeson et al. |
| 2006/0228435 | A1 | 10/2006 | Andrady et al. |
| 2006/0261309 | A1 | 11/2006 | Li et al. |
| 2006/0262310 | A1 | 11/2006 | Starry et al. |
| 2006/0264140 | A1 | 11/2006 | Andrady et al. |
| 2006/0268544 | A1 | 11/2006 | Rains et al. |
| 2007/0029526 | A1 | 2/2007 | Cheng et al. |
| 2007/0240346 | A1 | 10/2007 | Li et al. |
| 2008/0110342 | A1 | 5/2008 | Ensor et al. |
| 2008/0111472 | A1 | 5/2008 | Liu et al. |
| 2008/0113214 | A1 | 5/2008 | Davis et al. |
| 2008/0150556 | A1 | 6/2008 | Han et al. |
| 2008/0172197 | A1 | 7/2008 | Skipor et al. |
| 2008/0286856 | A1 | 11/2008 | Park et al. |
| 2009/0212695 | A1 | 8/2009 | Kim et al. |
| 2009/0251884 | A1 | 10/2009 | Rains |
| 2009/0273918 | A1 | 11/2009 | Falicoff et al. |
| 2009/0296384 | A1 | 12/2009 | Van De Ven et al. |
| 2009/0320340 | A1 | 12/2009 | Koren |
| 2010/0020531 | A1 | 1/2010 | Choi et al. |
| 2010/0027293 | A1 | 2/2010 | Li |
| 2010/0031617 | A1 | 2/2010 | Ensor et al. |
| 2010/0032695 | A1 | 2/2010 | Fellows-Demille et al. |
| 2010/0033948 | A1 | 2/2010 | Harbers et al. |
| 2010/0102199 | A1 | 4/2010 | Negley et al. |
| 2010/0103678 | A1 | 4/2010 | Van De Ven et al. |
| 2010/0290222 | A1 | 11/2010 | Pickard et al. |

FOREIGN PATENT DOCUMENTS

| | | | |
|---|---|---|---|
| WO | WO2007130536 | A2 | 11/2007 |
| WO | WO2009032378 | A2 | 3/2009 |
| WO | WO2009151515 | A1 | 12/2009 |
| WO | WO2010120900 | A1 | 10/2010 |
| WO | WO2011068682 | A1 | 6/2011 |

OTHER PUBLICATIONS

International Search Report dated Feb. 13, 2012 for PCT/US2011/048415.

International Preliminary Report on Patentability dated Mar. 7, 2013 for PCT/US2011/048429.

International Search Report dated Dec. 27, 2011 for PCT/US2011/048429.

International Preliminary Report on Patentability dated Mar. 7, 2013 for PCT/US2011/048440.

International Search Report dated Aug. 14, 2012 for PCT/US2011/048440.

International Preliminary Report on Patentability dated Mar. 7, 2013 for PCT/US2011/048456.

International Search Report dated Feb. 15, 2012 for PCT/US2011/048456.

Bowers et al. Journal of the American Chemical Society vol. 127 (2005) pp. 15378-15379.

Quantum Dots Lend New Approach to Solid-State Lighting, Sandia National Laboratory press release Jul. 24, 2003.

PHOTOLUMINESCENT NANOFIBER COMPOSITES, METHODS FOR FABRICATION, AND RELATED LIGHTING DEVICES

RELATED APPLICATIONS

This application is the national stage of International Patent Application No. PCT/US2011/048429, filed Aug. 19, 2011, titled "PHOTOLUMINESCENT NANOFIBER COMPOSITES, METHODS FOR FABRICATION, AND RELATED LIGHTING DEVICES", which claims the benefit of U.S. Provisional Patent Application Ser. No. 61/375,515, filed Aug. 20, 2010, titled "PHOTOLUMINESCENT NANOFIBER COMPOSITES, METHODS FOR FABRICATION, AND RELATED LIGHTING DEVICES;" the contents of which are incorporated by reference herein in their entireties.

FEDERALLY SPONSORED SUPPORT

This invention was made with government support under Award No. DE-FC26-06NT42861 by the U.S. Department of Energy. The United States Government may have certain rights in the invention.

TECHNICAL FIELD

The present invention relates generally to photoluminescent materials. In particular, the invention relates to photoluminescent nanofiber structures that include two or more different types of luminescent materials, method for fabricating photoluminescent nanofiber structures, and lighting devices utilizing photoluminescent nanofiber structures.

BACKGROUND

For general purpose illumination requiring white light, solid-state lighting (SSL) devices are being investigated as alternatives to conventional lighting devices such as incandescent and fluorescent lighting devices. Incandescent lighting (IL) devices emit white light by thermal radiation from a hot, electrically resistive filament. The spectral quality and color-rendering accuracy of incandescent light is high, approaching the performance of an ideal black-body radiator. However, incandescent lighting suffers from very low energy efficiency and operating lifetimes, with most of the energy input being converted to heat rather than useful emission of visible light. Fluorescent lighting (FL) devices emit white light from phosphor-coated surfaces in response to irradiation of those surfaces by ultraviolet (UV) light generated from energized mercury vapor. Fluorescent lighting is more energy efficient and has higher operating lifetimes, but typically has poor spectral quality. Moreover, incandescent and fluorescent lighting require light bulbs that must remain sealed to maintain a vacuum or contain a gas, respectively, and are prone to breaking.

On the other hand, SSL devices do not require sealed bulbs, have robust designs that do not require flexible or fragile components, and are highly energy efficient. SSL devices typically utilize LED lamps that produce light in narrow ranges of wavelengths (e.g., red, green or blue). White light-emitting SSL devices have been provided in two different configurations. In one configuration, the white light-emitting SSL device utilizes a closely-spaced cluster of red, green and blue LEDs to produce white light from the spectral composite of emissions from the LEDs. This "RGB LED" configuration enables the color of the white light to be adjusted if the associated electronic circuitry is configured to enable adjustment of drive currents provided to (and thus adjustment of the intensities of) the individual LEDs. However, a high cost is associated with the provision of multiple LEDs and complex drive circuitry. In another configuration, the SSL device utilizes a blue or UV LED packaged with one or more phosphors for converting the short-wavelength emission from the LED to longer-wavelength emissions, whereby white light is produced from the mixture of emissions in a manner similar to fluorescent lighting. Compared to RGB LED devices, the phosphor-converted LED approach is lower in cost but does not provide any means for adjusting the color of the white light. Consequently, color rendering index (CRI) values are low for phosphor-converted LED-based lighting devices. Generally, conventional SSL lighting devices of any type typically exhibit CRI values of less than 80.

Because the human eye is very sensitive to small variations in color, the end user can sometimes detect variations in correlated color temperature (CCT) as small as 10-20 K. Hence, lighting devices must be held to tight specifications to avoid noticeable color variation in large installations. Variations in CCT and CRI typically arise in SSL lamps due to manufacturing variability and are manifested as visible color variations in lighting devices equipped with SSL lamps. Currently, there is no economical way to manufacture a large number of white lighting devices that output the same character (e.g., tone, hue, etc.) of white color. There is also no practical way to adjust output color of a lighting device once it has been manufactured. Consequently, a batch of manufactured SSL devices must be screened at the end of the manufacturing line (end of line, or EOL) and sorted into bins according to CCT, CRI and other properties. This process is known as "binning" and results in all lighting devices of a given bin having approximately the same color. Different bins may then be provided to different customers or for different lighting installation projects. Binning is disadvantageous because it adds time, effort and cost to the manufacturing process. Moreover, binning is an imperfect solution to the problem of color variation. Binning does not correct color variation but rather separates lighting devices with similar colors into different groups. Moreover, the variation in color among the lighting devices of a given bin may still be noticeable. For instance, a bin of lighting devices may be provided to a customer who then installs them as lighting fixtures in the ceiling of a large meeting room. Different persons in different areas of the room may notice non-uniformities in the light provided by the lighting fixtures due to the inadequacy of the binning process.

In view of the foregoing, there is a need for providing improved designs of SSL devices and methods for their manufacture. Particularly there is a need for enabling tighter controls over the color of the light outputted by SSL devices, facilitating higher volume and lower cost manufacturing processes, and reducing the number of SSL devices that must be rejected as a result of binning operations.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, a photoluminescent nanofiber composite includes a substrate, first luminescent particles, and second luminescent particles. The substrate includes a plurality of nanofibers and a substrate surface. The first luminescent particles are supported by the nanofibers and span at least a portion of the substrate surface. The first luminescent particles are configured for emitting secondary light of a first wavelength in response to excitation by a light beam of a different wavelength. The second luminescent particles are disposed as one or more sections on the substrate. The layer includes a pattern of deposition units spaced from each other, with each deposition unit including a plurality of the second luminescent particles. The second luminescent particles are configured for emitting secondary light at a second wavelength different from the primary wavelength and from the first wavelength, in response to excitation by the light beam.

The second luminescent particles may be disposed on the first luminescent particles, or may be disposed directly on the substrate surface. In some implementations, the second luminescent particles are disposed in openings defined in a layer of the first luminescent particles.

In some implementations, the substrate is diffusively reflective of light of wavelengths ranging from about 380 to 760 nm. In some implementations, the substrate has a reflectivity of greater than 80% for light of wavelengths ranging from about 380 to 760 nm. In other implementations, the substrate has a reflectivity of 80% or less for light of wavelengths ranging from about 380 to 760 nm.

In some implementations, the substrate has a thickness ranging from 0.1 to 2,000 μm.

In some implementations, the nanofibers are composed of an organic polymer, a copolymer, and/or a polymer blend.

In some implementations, the nanofibers have an average diameter ranging from 10 to 5,000 nm. In other implementations, the nanofibers have an average diameter ranging from 350 to 800 nm.

In various implementations, the first luminescent particles and the second luminescent particles include red emitters, orange emitters, yellow emitters, green emitters, and/or blue emitters.

In some implementations, the deposition units are spaced from each other along at least one direction by a distance ranging from 0.01 to 1 inch.

According to another implementation, the photoluminescent nanofiber composite includes a surface treatment coating. In one implementation, the surface treatment coating is disposed on the substrate surface, wherein the first luminescent particles are disposed on the surface treatment coating. In another implementation, the surface treatment coating is disposed on the first luminescent particles, wherein the second luminescent particles are disposed on the surface treatment coating. In another implementation, a first surface treatment coating is disposed on the substrate surface, and a second surface treatment coating is disposed on the first luminescent particles.

According to another implementation, a lighting device includes a housing, a light source, and a photoluminescent nanofiber composite. The housing encloses a housing interior and includes a light exit for outputting a combination of primary light and secondary light. The light source is configured for emitting a primary light beam of a primary wavelength through the housing interior. The photoluminescent nanofiber composite faces the housing interior and includes a substrate, first luminescent particles, and second luminescent particles.

According to another implementation, a method is provided for fabricating a photoluminescent nanofiber composite. A plurality of first luminescent particles are deposited on a nanofiber substrate such that the first luminescent particles are supported by the nanofibers and span at least a portion of a substrate surface of the substrate. A layer of second luminescent particles are deposited on at least a portion of the first luminescent particles. The layer includes a pattern of deposition units spaced from each other, with each deposition unit including a plurality of the second luminescent particles.

In some implementations, a dispensing device is operated to transport the first or second luminescent particles toward the substrate. The dispensing device may be or include, for example, a syringe, a capillary, a printing pen, a printhead, a spray nozzle, an electrospray needle, or an aerosol handling apparatus.

In some implementations, the second luminescent particles are deposited in deposition units having shapes such as, for example, stripes, lines, circles, dots, ellipses, diamonds, and/or polygons.

In some implementations, the second luminescent particles are deposited through a mask to define the one or more sections.

In some implementations, the second luminescent particles are deposited in one or more layers.

According to another implementation, the nanofibers are formed from a polymer-inclusive solution. The nanofiber may then be collected and formed into the substrate.

According to another implementation, a method is provided for fabricating a photoluminescent nanofiber composite. One or more first layers of first luminescent particles are deposited on a surface of a nanofiber substrate such that the one or more first layers cover at least a portion of the surface. One or more second layers of second luminescent particles are deposited on at least a portion of the first layer such that the one or more second layers cover at least a portion of the first layer. The second layer includes a pattern of deposition units spaced from each other, with each deposition unit including a plurality of the second luminescent particles.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1A:
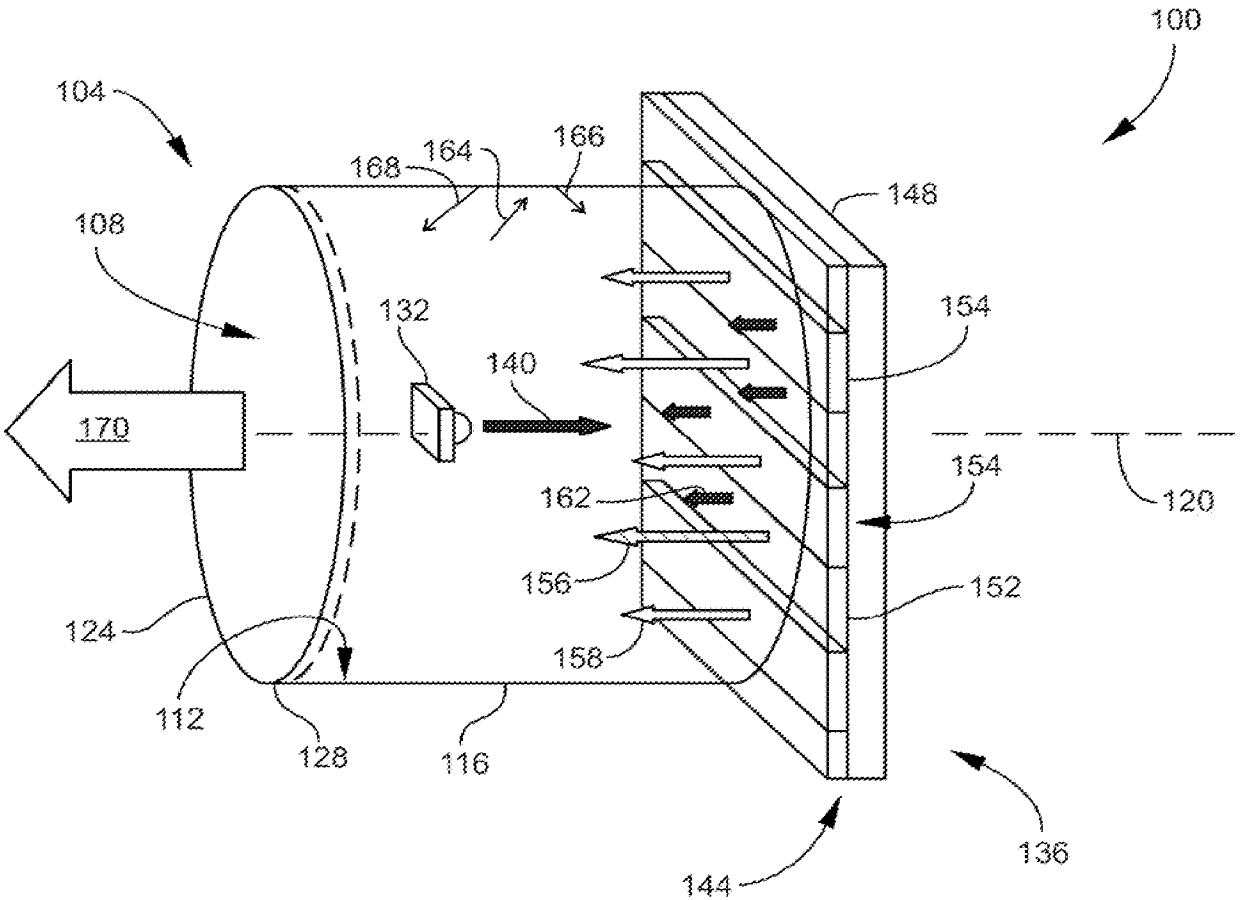
FIG. 1A is a perspective view of an example of a lighting device according to the present teachings.

As used herein, the term "nanofiber" refers to a typically solid structure that has one dimension (e.g., diameter) in the 10-5000 nm range, while the other dimension (e.g., length) may be quite long such as on the order of meters. Nanofibers may be made from a variety of materials, including polymers, ceramics, glasses, and sol gels, and blends of materials may also be readily fabricated. One feature of nanofibers is their small diameter relative to their length and consequently high surface area and aspect ratio (length:diameter). Nanofiber diameters on the order of visible light (about 380-760 nm) or even smaller may be readily produced, thereby creating very large surface areas.

As used herein, the term "luminescent particle" or "light-stimulable particle" refers generally to any photoluminescent (PL) particle. In typical implementations, the luminescent particles are capable of forming a composite with a suitable substrate, which may be amorphous, (poly)crystalline, or fibrous. As examples, the luminescent particles may be provided as one or more layers or regions on the substrate, as a distribution embedded in the substrate, as an interpenetrating network in the substrate, or as a distribution supported on or in fibers of the substrate. Examples of luminescent particles include quantum dots, phosphors, nano-phosphors, and organic dyes. While some luminescent particles may exhibit luminescent behavior by other mechanisms (e.g., electroluminescence), typical implementations taught herein rely principally on the photoluminescent response of particles. Accordingly, for convenience the terms "luminescent" and "PL" will be used interchangeably in the present disclosure in the context of particles or related materials that exhibit photoluminescence, without intending to exclude other types of luminescent activity.

As used herein, the term "quantum confined semiconductor particle" or "quantum dot" (QD) refers to a semiconductor nanocrystal-based material in which excitons are confined in all three spatial dimensions, as distinguished from quantum wires (quantum confinement in only two dimensions), quantum wells (quantum confinement in only one dimension), and bulk semiconductors (unconfined). A quantum dot may generally be characterized as a particle, the shape of which may be spherical, cylindrical, ellipsoidal, polygonal, or other shape. The "size" or "particle size" of the quantum dot may refer to a dimension characteristic of its shape or an approximation of its shape, and thus may be a diameter, a major axis, a predominant length, etc. The size of a quantum dot is on the order of nanometers, generally ranging from 1-1000 nm, but more typically ranging from 1-100 nm, 1-50 nm, 1-20 nm, or 1-10 nm. In a plurality or ensemble of quantum dots, the quantum dots may be characterized as having an average size. The size distribution of a plurality of quantum dots may or may not be monodisperse, but in some implementations may preferably be monodisperse through controlled synthesis so as to provide consistent light emission. The quantum dot may have a core-shell configuration, in which the nanocrystalline core and surrounding shell may have distinct compositions. The shell is typically an inorganic compound with a higher band gap than the core material. The shell may serve a function such as, for example, chemically stabilizing the core, isolating the core from the environment, etc. The optical properties of core-shell quantum dots are typically determined by their core. The quantum dot may also be capped with ligands attached to its outer surface (core or shell) or may otherwise be functionalized with certain chemical moieties for a specific purpose, such as providing compatibility with a solvent, serving as a surfactant to promote solution and prevent agglomeration, etc. Agglomeration may be disadvantageous for a number of reasons, including altering the emission characteristics to a degree noticeable by the human eye.

Quantum dots are advantageous because they function at temperatures that do not require an associated lighting device to provide temperature controlling means. Moreover, quantum dots may be produced utilizing relatively low-cost and easily implemented processing techniques, such as in the case of solution-processed colloidal quantum dots. Furthermore, the quantum confinement results in many optical, electrical and chemical properties of the quantum dot (e.g., band gap) being strongly dependent on its size, and hence such properties may be modified or tuned by controlling the size of the quantum dot during synthesis. For example, two quantum dots having the same composition but different sizes may respectively emit photons at different wavelengths in response to the same stimulus. Generally, for many quantum dot compositions smaller sizes emit radiation at shorter wavelengths and larger sizes emit radiation at longer wavelengths. Some properties may also depend on the shape of the quantum dot. Accordingly, a combination of different quantum dots (different as to composition, size and/or shape) may be provided in a PL material to provide secondary light emission at two or more different wavelengths. Different quantum dots may be distributed as a mixture or may be partitioned into separate regions or zones on or in a substrate. Partitioning may be preferable for preventing absorption by one type of quantum dot of a photon emitted by another type of quantum dot, and/or for facilitating the color tuning techniques described below.

As used herein, the term "phosphor" refers to a luminescent particle typically composed of an inorganic host material (e.g., aluminum garnet, metal oxides, metal nitrides, metal oxynitrides, metal sulfides, metal selenides, metal halides, or metal silicates) that includes an activator (e.g., copper, silver, europium, cerium or other rare earth metals). Typically, the activator is added as a dopant. Within the host material, the activators function as centers of luminescent emission. Typically, the size of a phosphor particle is 1 μm or greater. The term "nano-phosphor" refers to a phosphor having a particle size of 100 nm or less. Nano-phosphors often have similar chemistries as the larger-size phosphors but scatter light to a lesser degree due to their smaller size. As nano-particles, nano-phosphors may have various attributes similar to those of quantum dots.

As used herein, the term "reflective" means that a given material (whether a surface or a bulk region of the material) reflects greater than 80% of incident light of a given wavelength or wavelengths. The term "transparent" or "light-transmitting" means that a given material is able to efficiently pass greater than 50% of incident light of a given wavelength or wavelengths. Unless specified otherwise, the term "transparent" or "light-transmitting" encompasses the terms "partially transparent" and "translucent."

For purposes of the present disclosure, the spectral ranges or bands of electromagnetic radiation are generally taken as follows, with the understanding that adjacent spectral ranges or bands may be considered to overlap with each other to some degree: Ultraviolet (UV) radiation spans the range of about 10-400 nm, although in practical applications (above vacuum) the range is about 200-400 nm. Visible radiation spans the range of about 380-760 nm. Violet radiation spans the range of about 400-450 nm. Blue radiation spans the range of about 450-490 nm. Green radiation spans the range of about 490-560 nm. Yellow radiation spans the range of about 560-590 nm. Orange radiation spans the range of about 590-635 nm. Red radiation spans the range of about 635-700 nm.

In the present context, the term "color" refers to the appearance of emitted light as perceived by the human eye. Color may be described by a measurable property (or "color parameter") of the light such as, for example, color rendering index (CRI), correlated color temperature (CCT), chromaticity coordinates (x,y), (u,v) or (u',v'), and distance from Plankian locus ($D_{uv}$), as may be defined by CIE (International Commission on Illumination) standards. The CRI is a measure of the ability of a white light source to faithfully reproduce the color appearance of objects in comparison to a reference light source such as a black-body radiator or daylight. The general color rendering index adopted by CIE, designated $R_a$, is typically utilized. The CRI of an ideal reference source having a balanced spectral power distribution (SPD) is defined as 100. Hence, high CRI values are desirable for actual light sources, for example, greater than 80 for interior lighting. The color temperature of a light source emitting light of a given hue corresponds to the temperature (in degrees Kelvin) of an ideal black-body radiator emitting light of a comparable hue. However, black-body radiators emit light by thermal radiation while light sources such as SSL lamps primarily emit light by non-thermal mechanisms. Therefore, for these types of light sources a correlated value (CCT) is utilized as an approximation. Higher color temperatures (5,000K and above) are termed "cool" colors and appear bluish, while lower color temperatures (2,700-3,000K) are termed "warm" colors and appear yellowish to reddish. Intermediate color temperatures may be termed "neutral" colors. Warmer colors are often utilized for illuminating public areas to promote relaxation, while cooler colors are often utilized in office areas to promote concentration. All color temperatures visible to the average human eye (i.e., the gamut of human vision) may be shown, in color, in the color space of the CIE 1931 (x,y) chromaticity diagram (see, e.g., FIG. 10), the CIE 1960 (u,v) uniform chromaticity space (UCS) diagram, or the CIE 1976 (u',v') uniform chromaticity scale (UCS) diagram. Except for brightness, a color may be described by its chromaticity, i.e., its x-y or u-v coordinate position on a chromaticity diagram. A chromaticity diagram may also show the Planckian locus, which is the path taken through the color space by a black-body radiator as its temperature changes. In a direction from lower to higher color temperature, the Planckian locus runs from deep red through orange, yellowish white and white, to bluish white. The distance of a color's coordinate position from the Planckian locus may be utilized to calculate CRI and CCT. The CIE (u,v) or (u',v') diagram is typically utilized to calculate distance from the Planckian locus. CIE (x,y) coordinates may be converted to CIE (u,v) or (u',v') coordinates utilizing known transformations.

As described by way of examples below, photoluminescent nanofiber (PLN) composites or structures are provided for use in applications requiring a source of secondary light emissions. A PLN composite as disclosed herein may be utilized, for example, as a light converter in various types of lighting devices (i.e., luminaires or light fixtures). Light outputted from a lighting device will be referred to as "output light." The PLN composite may be configured in a desired manner to determine the color of the output light. Of particular value are lighting devices configured to produce white output light. Lighting devices utilizing PLN composites designed and fabricated as disclosed herein are able to produce high efficiency, high color-rendering white output light. The PLN composite may be configured and fabricated in a manner that ensures a desired color of the output light, which may be in accordance with one or more specified color parameters such as, for example, SPD, CRI, CCT, chromaticity coordinates, and distance from Plankian locus. The PLN composite may be configured for a specific purpose. For example, in the case of a white lighting device the PLN composite may be configured to render the white light warm (yellowish or reddish, e.g., CCT=2,600-3,700 K), neutral (e.g., CCT=3,700-5,000 K), or cool (bluish, e.g., CCT=5,000-10,000 K). The PLN composite may be configured for certain intended end uses of the lighting device such as general lighting in a relaxing environment, general lighting for concentration in an office environment, lighting for reading, etc.

The PLN composite is configured for emitting secondary light in response to excitation by an incident beam of primary light (also termed excitation light, or pump light). For this purpose, the PLN composite may include a nanofiber substrate and two or more different luminescent materials. As noted, the luminescent materials are typically photoluminescent (PL) materials. Typically, emission of secondary light from a PL material occurs through the mechanism of fluorescence. Depending on the type of PL material utilized, the secondary wavelength may be shorter or longer than the primary wavelength. Typically, the PL material is configured to emit a longer wavelength as short-wavelength light sources are readily available and shorter-to-longer wavelength conversions tend to be more efficient. The two or more different types of PL materials may be configured to emit secondary light at two or more respective wavelengths in response to excitation by the incident primary light beam. For example, the PL materials may include both red-emitting and green-emitting materials, which in some implementations may be utilized in conjunction with a blue, violet or UV light source to produce white light.

In some implementations, the PLN composite includes a nanofiber substrate, a first layer of a PL material provided in the form of first luminescent particles, and at least one more layer of a PL material provided in the form of second luminescent particles of a different type. The PLN composite may also include surface modifiers between the layers. In some implementations, the first luminescent particles are supported by a substrate. In this context, "supported by" means that the luminescent particles are disposed on nanofibers of the substrate as a more or less distinct layer, and/or encapsulated or embedded in the substrate or in nanofibers thereof in a stable manner. The luminescent particles may be QDs, phosphors, nano-phosphors, organic dyes, or a combination of two of more of the foregoing. Color parameters such as CCT may be controlled by controlling the quantity of luminescent particles over a unit area of the PLN composite (i.e., density), the thickness of a layer of luminescent particles, the composition of the luminescent particles, etc. Different types of luminescent particles may be utilized simultaneously. As one example, a PLN composite may include one or more sections of green-emitting phosphors and one or more sections of red-emitting QDs. In another example, a PLN composite may be made from one or more sections containing a mixture of one or more phosphors (e.g., green and yellow) and one or more sections made from a mixture of quantum dots (e.g., orange and red). Additionally, the PLN composite may include an added reflective material, examples of which are described below.

A method for fabricating the PLN composite may include a two-phase deposition process. The process may entail a primary deposition of a luminescent material configured to produce secondary emission predominantly of one color, followed by a secondary patterned deposition of a luminescent material configured to produce secondary emission predominantly of a different color. The secondary overprinting allows for tight control over the end properties of the PLN composite and the lighting device or other device utilizing the PLN composite.

In some implementations taught in the present disclosure, a lighting device includes one or more primary light sources, one or more light converters (or "secondary converters"), and a housing. The lighting device may also include one or more reflective materials (or reflectors).

The primary light source may be any suitable light source for generating a beam of primary light and directing the beam through an interior of the housing toward the light converter. In this context, primary light is electromagnetic radiation propagating at any desired wavelength (visible or non-visible) that is sufficient to induce emission from the light converter of electromagnetic radiation at one or more wavelengths different from the primary (or excitation) wavelength and within the visible spectrum. This type of emission will be referred to as secondary light or secondary emission. In typical implementations, the primary light source is configured for emitting radiation of relatively short wavelengths such as UV, violet or blue. No specific limitation is placed on the type of primary light source, although in typical examples the primary light source is an electroluminescent (EL) device such as a laser diode (LD) or more typically a light-emitting diode (LED). In the context of lighting applications, an EL device may be referred to as a solid-state lighting (SSL) lamp or SSL device. An LED (or other EL device) may be based on a conventional system of inorganic semiconductor materials such as Group III (In, Al, Ga) nitrides, or may be an organic LED (OLED), a polymer LED (PLED), or a hybrid design utilizing both inorganic and organic components.

The light converter may be any PLN composite, or any structure that includes a PLN composite. Examples of PLN composites are described further below. In various implementations, the light converter may be positioned remotely from the light source. By this configuration, luminescence occurs over a large surface area resulting in improved uniformity in color, and thermal degradation by heat generated from the light source is reduced or eliminated. The light converter, or the PLN composite serving as or forming a part of the light converter, may be rigid or flexible.

The housing generally may be any structure suitable for containing visible electromagnetic radiation during optical processing of the radiation by the lighting device and prior to output of the radiation from the lighting device. In particular, the housing may be any structure that provides an interior or cavity suitable for mixing (or combining) primary light components and secondary light components, and a light exit or aperture through which the mixed (or composite) light emanates to the ambient environment outside the lighting device. Additionally, the housing may serve as a structure for mounting or supporting one or more other components of the lighting device. The light exit may be an uncovered opening or may include a light-transmitting structure that spans the opening. The light-transmitting structure may serve to protect components residing in the housing interior from the ambient environment. Additionally, the light-transmitting structure may be or include an optical component configured to perform an optical processing function on the output light, such as promoting the mixing or diffusion of the primary and second light components, focusing the output light as a beam (e.g., a lens, etc.). It will be noted that lighting devices as taught herein do not require color filters.

A reflective material may be mounted in a suitable location in the housing interior or may be integrated with the housing. For example, the reflective material may line an inside surface of the housing that bounds all or a portion of the housing interior. The reflective material may be a structure that is inherently reflective throughout its bulk, or may be a reflective surface or outer region of a structure, or may be a reflective coating applied to a structure. The reflective material may be a specular reflector such as, for example, a layer or silver (Ag) or aluminum (Al). The reflective material may alternatively be a diffuse reflector such as, for example, a white paint or ink, a non-woven fabric, or a non-woven fabric to which a white paint or ink has been applied. In some implementations, the reflective material is a non-woven mat or substrate formed from a plurality of nanofibers and is highly diffusive. The nanofiber substrate may be the same type of structure as the above-noted substrate utilized to create a PLN composite. A nanofiber substrate or other type of diffuse reflector may perform as a Lambertian reflector, whereby the brightness of the light scattered from the surface appears to an observer to be the same regardless of the observer's angle of view relative to the surface.

The color of the output light produced by the lighting device depends on the composition of the wavelengths at which the output light is emitted from the light exit of the lighting device. The wavelength composition in turn depends on the wavelengths of light respectively emitted by the light source and the light converter as well as on how the various paths of light components are manipulated or processed (e.g., modulated, reflected, steered, combined, etc.) within the housing interior. The output light may fall primarily within a wavelength band associated with a particular color, or may be a broad-spectrum white light. The lighting device in some implementations produces white light having a CRI of greater than 70, while in other implementations produces white light having a CRI of greater than 80 or greater than 90. These high CRI values may be achieved with the use of either a short-wavelength light source (e.g., UV, violet, or blue) or a white light source (e.g., a white LED) in combination with the PLN composite emitting secondary light of selected wavelengths. When a white LED is utilized as the light source, the lighting device is able to significantly improve the CRI of the white LED, in some implementations by as much as 35%. In one example, the CRI value of a while LED is rasied from 67 to 90, representing a significant improvement in color rendering properties of the light source. In various implementations, the output light may have a CCT ranging from 2,500 to 5,500 K. The output light may be tailored to attain any CCT value over this range through the design and fabrication of the PLN composite as described below.

FIG. 1A is a perspective view of an example of a lighting device 100 according to the present teachings. The lighting device 100 includes a housing 104 surrounding a housing interior 108 and a reflective surface 112 disposed in the housing interior 108. In the present example, the housing 104 includes a substrate 116 and the reflective surface 112 is disposed on the substrate 116 whereby the housing interior 108 serves as a reflective cavity. The housing substrate 116 may have any suitable composition. In the present example, the housing substrate 116 is a polymer such as polyvinyl chloride (PVC). Also in the present example, the reflective surface 112 is a diffusive reflective surface and may perform as a Lambertian reflector for the wavelengths at which light components propagate in the housing interior 108. In one specific example, the reflective surface 112 is implemented as one or more layers of highly diffusive nanofibers as described further below. Alternately, the reflective surface 112 may be substantially specular. Generally, the housing 104 (or at least its inside surface) and the reflective surface 112 may have any shape, but advantageously have a shape that promotes distribution and reflection of light components. In the present example, the housing 104 has an axial configuration by which at least the inside surface of the housing 104 is coaxial and symmetrical with a central axis 120. For instance, the housing 104 or its inside surface may be cylindrical. The housing 104 includes a light exit 124 at one axial end. The light exit 124 may be covered with a light-transmitting structure 128 as noted above.

The lighting device 100 further includes a primary light source 132 and a light converter 136. The lighting device 100 further includes a source of electrical power and associated circuitry (not shown) of a design appropriate for powering and controlling the type of light source 132 utilized. In some implementations, the light source 132 is an LED. For example, the light source 132 may be a high-brightness LED such as one from the XLamp® XR-E series commercially available from Cree, Inc., Durham, N.C. The light source 132 is configured to generate and emit a primary light beam at a primary wavelength $\lambda_{em}$, which in FIG. 1A is schematically represented by an arrow 140. The lighting device circuitry may be configured to enable adjustment of the drive current to the light source 132 and thus adjustment of the intensity of the primary light beam 140. However, as will become evident below the lighting device 100 is able to produce a desired color without the need for varying drive current. For purposes of description, the light source 132 and its light beam 140 may be characterized as lying on a nominal output axis of the light source 132. The nominal output axis is generally an axis projecting from the optical output side of the light source 132 directly to the light converter 136 in a straight line, and depicts the general or resultant direction in which the primary light beam 140 is aimed toward the light converter 136. This output axis is "nominal" in the sense that the primary light beam 140 is not necessarily so coherent as to be constrained to the immediate vicinity of the output axis. Instead, in typical implementations the primary light beam 140 has a relatively wide angle of divergence (e.g., is cone-shaped). Depending on the scale of the lighting device 100 and the axial distance between the light source 132 and the light converter 136, a portion of the primary light beam 140 may be directly incident on the reflective surface 112 instead of the light converter 136. Hence, the angular emission of the light source 132 may play a significant role in the performance of the lighting device 100.

While in FIG. 1A the nominal output axis is collinear with the central axis 120 of the housing interior 108, this configuration is illustrated by example only. The light source 132 may be mounted such that the nominal output axis is offset from the central axis 120 by a radial distance (orthogonal to the nominal output axis). Moreover, the nominal output axis may not be parallel with the central axis 120 and instead may be at an angle to the central axis 120. The light source 132 may be mounted or suspended in the housing interior 108 and aimed at the light converter 136 by any suitable means. In the present example, the light source 132 is axially interposed between the light exit 124 and the light converter 136. Alternatively, the light source 132 may be axially located at the light exit 124. In implementations where a light-transmitting structure 128 is provided at the light exit 124, the light source 132 may be supported by the light-transmitting structure 128. In other alternatives, the light source 132 may be located outside the housing interior 108 or mounted to the housing substrate 116. More generally, the light source 132 is located so as to direct the primary light beam 140 through the housing interior 108 and toward the light converter 136.

In the illustrated example, the light converter 136 is mounted at the opposite axial end of the housing 104. Alternatively, the light converter 136 may be mounted within the housing interior 108, in which case the opposite axial end may be covered by a reflective surface. The light converter 136 is or includes a PLN composite 144 facing the housing interior 108. The light converter 136 may also include an additional substrate or structure 148 on which the PLN composite 144 is disposed or mounted. The additional structure 148 may serve as a base or frame for the PLN composite 144, and may be configured to render the light converter 136 removable from the lighting device 100 such that the light converter 136 can be replaced with another light converter having the same or different configuration of PLN composite 144. The substrate of the PLN composite 144 may be reflective. In advantageous implementations, the substrate of the PLN composite 144 may be diffusively reflective to an appreciable degree so as to promote distribution and mixing of primary light and secondary light in the housing interior 108. Alternatively, particularly in implementations in which the light converter 136 is mounted within the housing interior 108, the substrate of the PLN composite 144 may be at least partially light-transmitting, in which case some components of primary light and secondary light may be emitted from the back side of the PLN composite 144 and reflected by a reflector (not shown) located at the axial end. Moreover, the PLN composite 144 may span the entire cross-section of the axial end of the housing 104 as shown in FIG. 1A, or alternatively may span only a portion of the cross-section, in which case some of the primary light emitted from the light source 132 may bypass the PLN composite 144 and be reflected from a reflective surface in the housing interior 108.

In the illustrated example, the PLN composite 144 includes a combination of two different types of luminescent materials, i.e., a first PL material 152 and a second PL material material 154, which emit secondary light at two respective wavelengths $\lambda_1$ and $\lambda_2$ as schematically represented by respective arrows 156, 158 in FIG. 1A. The different PL materials 152, 154 may be arranged in a desired pattern. FIG. 1A illustrates one alternative in which the respective PL materials 152, 154 are arranged in an alternating series of horizontally oriented stripes (the horizontal orientation being merely an example, and merely a consequence of the perspective of FIG. 1A). Some of the primary light incident on the PL materials 152, 154 may not excite a fluorescent or wavelength-shifting response (i.e., not cause re-emission at a different wavelength) and instead is reflected back from the light converter 136. This "unconverted" primary light is schematically represented by other arrows 162 in FIG. 1A.

In operation, activation of the lighting device 100 entails providing power to the light source 132 to energize its light-emitting components. In response, the light source 132 generates the primary light beam 140, which is directed generally toward the light converter 136. A portion of the primary light beam 140 is directly incident on the PL materials 152, 154, i.e., reaches the PL materials 152, 154 without first encountering any other component in the housing interior 108. Another portion of the primary light beam 140 may be directly incident on the reflective surface 112, as schematically represented by an arrow 164 in FIG. 1A. Depending on the diffusivity of the reflective surface 112, some of the primary light striking the reflective surface 112 may then be reflected toward the PL materials 152, 154 as schematically represented by an arrow 166, while another portion of the primary light striking the reflective surface 112 may be reflected toward the light exit 124 as schematically represented by another arrow 168. As regards the primary light striking the PL materials 152, 154, whether directly from the light source 132 (e.g., arrow 140) or as a result of reflection from the reflective surface 112 (e.g., arrow 166), a portion of this incident primary light (140, 166) is converted to secondary light 156, 158 while another portion remains unconverted (162). Components of the unconverted primary light 162 reflected from the PL materials 152, 154, the primary light 166, 168 reflected from the reflective surface 112 without having first struck the PL materials 152, 154, and the secondary light 156, 158 generated by photoluminescence may propagate in different directions through the housing interior 108 and may be reflected one or more times by the reflective surface 112. A mixture of these components passes through the light exit 124 as output light, as schematically represented by a large arrow 170. The output light 170 comprises an ensemble of the primary and secondary wavelengths of electromagnetic radiation ($\lambda_{em}+\lambda_1+\lambda_2$), and this composition of wavelengths determines the perceived color of the output light 170. The lighting device 100 is structured such that the optical mixing of the different light components ($\lambda_{em}+\lambda_1+\lambda_2$) is sufficient to produce output light 170 of a desired color having a highly uniform appearance.

As one non-limiting example, the light source 132 may be a short-wavelength emitter such as a blue emitter (e.g., $\lambda_{em}$~450 nm), the first PL material 152 may be an intermediate-wavelength emitter such as a green emitter, and the second PL material 154 may be a longer-wavelength emitter such as a red (or red-orange, or orange) emitter. This configuration results in the output light 170 being white (i.e., broadband visible light). In another example, the light source 132 may be a cool white emitter (typically a phosphor-converted "white" LED) and the PL material may be a red emitter. This configuration results in the output light 170 being warm white. The light converter 136 may also include regions in which PL materials are absent but which reflect the incident primary light—in effect, the reflective regions add another emitter corresponding to the primary light wavelength (e.g., a blue emitter in the case where a blue light source 132 is utilized).

In other implementations, the PLN composite 144 may include more than two different types of luminescent materials (as well as a reflective material) in any desired pattern or alternating sequence. For example, three different materials "Y", "R" and "B" may be provided. In a case where the lighting device 100 is intended to produce white output light 170, Y may represent a luminescent material providing the majority of secondary light utilized to balance the color of the primary light beam 140, R may represent a luminescent material providing secondary light in the long-wavelength part of the visible spectrum, and B may represent a reflective or luminescent material providing secondary light in the short-wavelength part of the visible spectrum. In the case of a blue light source 132, the Y material may be a yellow or green emitter, the R material may be a red, red-orange or orange emitter, and the B material may be a surface that reflects the blue excitation light (e.g., bare nanofibers or other type of reflective surface). For instance, the B material may be a white reflective material. The white reflective material may be a particulate material, examples of which include, but are not limited to, barium sulfate ($BaSO_4$), titanium (IV) oxide ($TiO_2$), alumina ($Al_2O_3$), zinc oxide (ZnO), Teflon® (polytetrafluoroethylene, or PTFE), and combinations of two or more of the foregoing. Alternatively, the B material may be another luminescent material. As examples, in the case of a UV light source 132 (e.g., $\lambda_{em}$~350-370 nm) the B material may be a blue or violet light source 132 (e.g., $\lambda_{em}$~408 nm), and in the case of a violet emitter the B material may be a blue emitter. As another example, the light source 132 may be a UV emitter or a violet emitter (e.g., $\lambda_{em}$~408 nm), the Y material may be a green or yellow emitter, the R material may be a red or orange emitter, and a B material may be a blue emitter. In any case where white output light 170 is desired, the pattern may be configured such that, when located in a desired position relative to the light source 132, the lighting device 100 produces a neutral tone, a cool tone (more blue is reflected or emitted), or a warm tone (more red or other long-wavelength radiation is emitted).

Testing of prototypes of the lighting device 100 illustrated in FIG. 1A with a two-inch diameter light exit 124 has demonstrated a fixture efficiency of typically 0.74 when either white or blue LED sources were utilized. Fixture efficiency is defined as the luminous output of the device divided by the luminous output of the LED lamp by itself. The efficiency is expected to increase upon further refinement of the design, such as by eliminating light leakages at the junction of the light converter 136 and the housing 104. More generally, the design of the lighting device 100 enables a great amount of flexibility in the selection of the light source 132, the PLN composite 144, and other fabrication parameters.

It will be appreciated that the sections of luminescent materials of the PLN composite 144 do not all need to have the same cross-sectional areas. Thus, in the example of FIG. 1A, the areas of one or more of the stripes of luminescent materials 152, 154 may vary, with some stripes being larger than other stripes, depending on the color parameters sought for the output light 170. Moreover, other patterns of different luminescent materials may be utilized. For example, the pattern may be an alternating array of circular sectors (i.e., pie-shaped segments) in which each circular sector contains a certain type of luminescent material. The central portion of the primary light beam 140 may illuminate an area of the pattern covering two or more adjacent sectors such that more than one type of luminescent material is illuminated. Depending on how the pattern is designed, the primary light beam 140 may be aimed at the center of the array of circular sectors or at a point offset from the center. The circular sectors may all have the same area or some circular sectors may have different areas than others. In other implementations, the PLN composite 144 may be shaped as a semicircle or an arcuate plate instead of a full circle, with truncated circular sectors or bands of different luminescent materials. In other examples, the pattern may include an alternating series of polygonal shapes (e.g., squares, rectangles, hexagons, triangles, trapezoids, diamonds, etc.) with two or more series of shapes respectively containing two or more different types of luminescent materials. In still other examples, the pattern may include rounded shapes (e.g., ellipses, circles, dots, etc.). Other examples include spirals and irregularly-shaped polygons as well as a pattern of dots or circles. Moreover, the pattern may include more than one type of shape. As examples, all first luminescent materials 152 may have one shape while all second luminescent materials 154 have a different shape, or some luminescent materials 152 and/or 154 may have one shape while other luminescent materials 152 and/or 154 have a different shape.

Moreover, in still other implementations the pattern need not be a uniform arrangement of first luminescent materials 152 and second luminescent materials 154. As one example, the first luminescent material 152 may cover a majority of the area of the light converter 136 while the second luminescent material 154 covers only a small section.

Figure 1B:
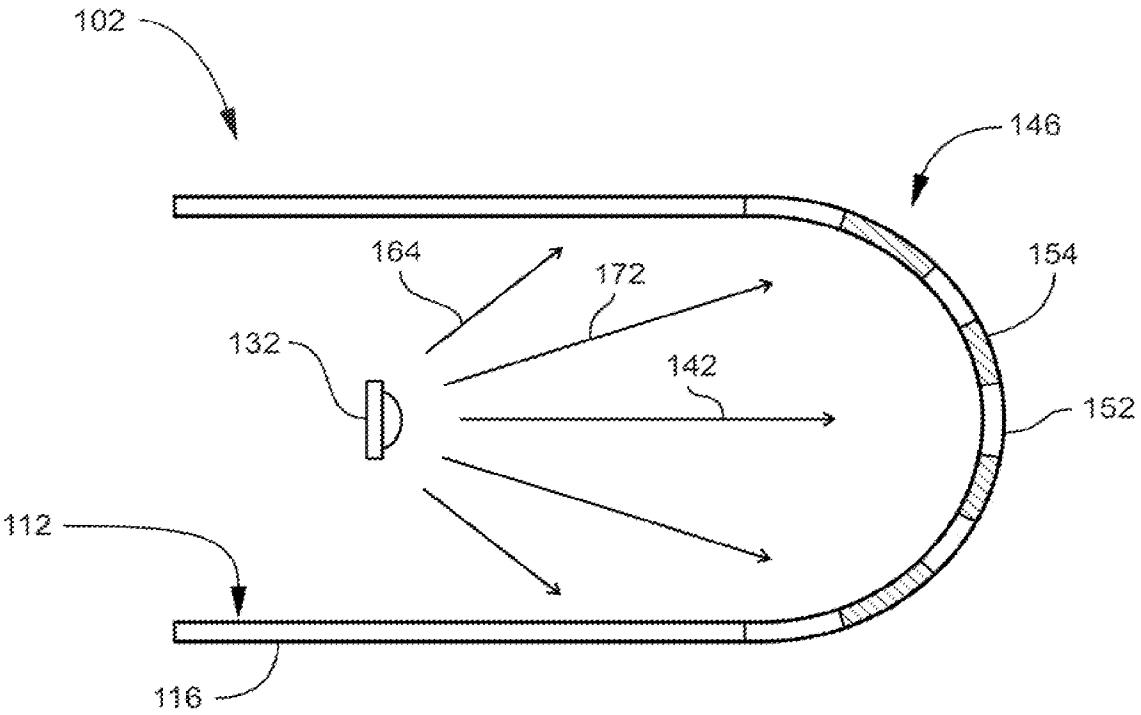
FIG. 1B is a cross-sectional view of another example of a lighting device according to the present teachings.

The PLN composite 144 described above has been schematically depicted as being planar. It will be understood, however, that the PLN composites utilized in the lighting devices encompassed by the present disclosure are not limited to any particular geometry. A PLN composite may have a curved profile or a complex geometry. As an example, FIG. 1B is a cross-sectional view of a lighting device 102 similar to that illustrated in FIG. 1A, but with the planar PLN composite 144 replaced with a curved PLN composite 146. The curved PLN composite 146 may be hemispherical, or conform to or approximate another type of conical section (e.g., ellipsoid, paraboloid, hyperboloid, etc.), or may follow another type of curvature. The curvature may be such that the radiant flux of the primary light beam incident on the PLN composite 146 is approximately constant over most or all of the side of the PLN composite 146 facing the light source 132. For example, in FIG. 1B the radiant flux of a portion 142 of the primary light beam directed along the nominal output axis may be equal or proximate to the radial flux of some or all portions 172 of the primary light beam directed at angles to the nominal output axis.

Figure 2:
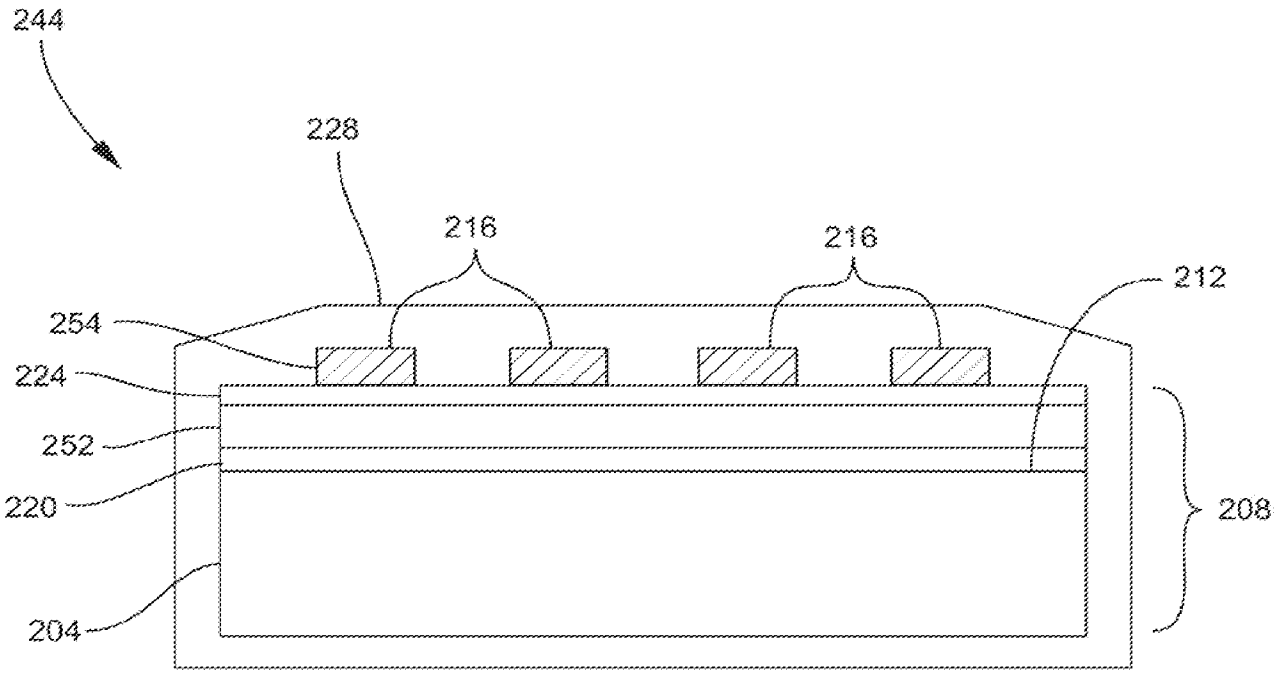
FIG. 2 is a cross-sectional view of an example of a photoluminescent nanofiber (PLN) composite that may be utilized in a lighting device such as illustrated in FIGS. 1A and 1B, according to the present teachings.

FIG. 2 is a cross-sectional view of another example of a PLN composite 244, illustrating compositional and structural details. The PLN composite 244 configured as illustrated in FIG. 2 may be representative of the PLN composite 144, 146 illustrated in FIGS. 1A and 1B or any other PLN composite described herein. The PLN composite 244 includes a nanofiber substrate 204, a plurality of first luminescent particles 252 supported by the nanofiber substrate 204, and a plurality of second luminescent particles 254 disposed on the nanofiber substrate 204. Methods for fabricating the nanofiber substrate 204 are described in more detail further below. The first and second luminescent particles 252, 254 may be of a single color (e.g., green or red) or alternatively the luminescent particles 252, 254 may contain a mixture of luminescent materials that emit at different wavelengths (λ). For example, the first luminescent particles 252 may be a mixture of blue, green, and yellow emitting luminescent materials and the second luminescent particles 254 may be a mixture of red and orange emitting luminescent materials.

Deposition of the first luminescent particles 252 forms a base PLN 208. In some implementations, the first luminescent particles 252 are disposed as a layer on a surface 212 of the substrate 204. In some implementations, the layer first luminescent particles 252 on the surface 212 may contain openings for the subsequent placement of the second luminescent particles 254 onto the surface 212 of substrate 204. The layer of first luminescent particles 252 may cover all or a portion of the substrate surface 212. The interface between the substrate surface 212 and the layer of first luminescent particles 252 may be relatively well-defined in the sense that most of the first luminescent particles 252 are supported by the outermost nanofibers (or layer of nanofibers) that form the substrate surface 212. Alternatively, some of the first luminescent particles 252 may penetrate into the network of nanofibers over part of the thickness (i.e., an upper region) of the substrate 204. Moreover, in some implementations, the first luminescent particles 252 may be supported by the nanofibers by being in contact with outside surfaces of the nanofibers. In other implementations, the first luminescent particles 252 may be supported by the nanofibers by being embedded or partially embedded in the nanofibers. The PLN composite 244 may include a combination of both types of particle-supporting nanofibers. Generally in any of the foregoing cases, the first luminescent particles 252 may be characterized as spanning at least a portion of the substrate surface 212 in the sense that the first luminescent particles 252 are distributed over an area coplanar with the substrate surface 212 and accessible by a primary light beam 140 (FIG. 1A) directed toward the substrate surface 212.

In some implementations, the second luminescent particles 254 are disposed as a layer or as multiple layers on the first luminescent particles 252. The layer of second luminescent particles 254 may cover all or a portion of first luminescent particles 252. By this configuration, the primary light beam 140 will directly strike the second luminescent particles 254 instead of the portion of the first luminescent particles 252 underlying the second luminescent particles 254. In many implementations, it is advantageous for the layer of second luminescent particles 254 to cover only a small area of the layer of first luminescent particles 252 so as to configure the lighting device 100 in a specific manner. Thus, in an example where the lighting device 100 is required to produce white output light 170 having a certain proportion of red wavelengths, the first luminescent particles 252 may be green emitters and cover all or a substantial portion of the nanofiber substrate 204 and the second luminescent particles 254 may be red emitters that cover a smaller area carefully sized to yield the proper proportion of red wavelengths. As further illustrated in FIG. 2, the layer of second luminescent particles 254 may include two or more sections 216 of second luminescent particles 254 to form a desired pattern of first and second luminescent particles 252, 254, such as the alternating stripes illustrated in FIG. 1A or any other pattern described herein.

In other implementations, the second luminescent particles 254 may be disposed directly on the nanofiber substrate surface 212, and may be disposed in one or more sections alongside one or more sections of the first luminescent particles 252 in accordance with any desired pattern or arrangement. In some implementations, openings may be formed in the layer of first luminescent particles 252 on the surface 212 by a suitable patterning technique, and the second luminescent particles 216 may be subsequently deposited onto the surface 212. The second luminescent particles 216 may or may not fill the openings completely. For instance, there may be a gap between the edge of an opening and the outer extent of the second luminescent particles 216 located in that opening, such that a bare nanofiber border is exposed in this gap between the first and second luminescent particles 252, 254.

As noted above, the first and second luminescent particles 252, 254 may be QDs, phosphors, nano-phosphors, organic dyes, or combinations of two or more of the foregoing. If desired, one or both layers of particles may also include white reflective particles, examples of which are noted elsewhere in the present disclosure. In typical implementations, each layer of particles is deposited as a solution or ink that includes luminescent and/or reflective particles and one or more appropriate solvents. In the present context, for convenience the term "deposited" represents any technique for adding particles, whether by material transport (e.g., printing, coating via an applicator or dispenser instrument, etc.), immersion, self-assembly, etc. Depending on the types of particles to be deposited, the solvents may be organic or inorganic and may be polar or non-polar. The solution may also include any additives deemed appropriate or necessary, such as particle dispersants, surfactants, viscosifiers, agents that inhibit agglomeration or slumping, agents that control solution rheology, agents that promote adhesion to the target surface receiving the solution, agents that control wetting properties, agents that control the resolution of the pattern of the particles applied to the target surface, agents that facilitate the use of a particular dispensing device utilized to apply the solution to the target surface and/or agents that control any other property of the solution deemed important. As a few specific but non-limiting examples, the additive BYK®-411 commercially available from BYK-Chemie GmbH, Germany may be added as a surfactant, and the alkyd Beckosol® 11-035 commercially available from Riechhold Inc., Durham, N.C. may be added as a dispersant. After deposition, the solution may be cured to form a stable, permanent layer of particles. Curing may be carried out in any manner suitable for the composition of the particles being deposited, such as, for example, air drying, heating, UV-curing, etc. Curing may entail the evaporation of excess volatile components, which may be assisted by vacuum.

Any dispensing technique suitable for the type of solution and non-destructive of the underlying component may be utilized. Preferably, the dispensing technique is one that deposits particles uniformly on the underlying component. One or more of the additives noted above may also ensure uniform deposition. Examples of dispensing techniques include, but are not limited to, printing techniques, wet coating techniques, and dry coating techniques. Examples of printing techniques include, but are not limited to, ink-jet printing, digital printing, screen printing, thermal printing, transfer printing, etc. Examples of wet coating techniques include, but are not limited to, spray coating, dip coating, drop coating, spin coating, electrospray coating, doctor blading, deposition of Langmuir-Blodgett film, self-assembly of monolayers (SAMs) from liquid or vapor phase, etc. Examples of dry coating techniques include, but are not limited to, aerosol dry coating. Non-immersion techniques may utilize a suitable solution or ink dispensing apparatus (i.e., a dispenser or applicator) that may be manipulated manually or in an automated manner. Examples of dispensers include, but are not limited to, a syringe, a capillary, a printing pen, a printing pad or stamp, an ink-jet printing head, a spray nozzle, an electrospray needle, devices utilized in microfluidics, micro-total analysis, labs-on-a-chip, etc.

In typical implementations, the first luminescent particles 252 span all or a substantial portion of the area of a face of the nanofiber substrate 204 to form a base PLN 208. In some implementations, a less precise or less directional (i.e., a "broad beam") deposition technique may be utilized such as dip coating or spray coating. A more precise deposition technique such as ink-jet printing, spray coating with a highly-controllable solution applicator, or the like may be utilized to form a single, precisely sized and shaped section 216 of second luminescent particles 254 or a specific pattern of sections 216 of second luminescent particles 254. Alternatively, a less precise deposition technique may be utilized in conjunction with a hard mask (not shown) in a manner analogous to semiconductor fabrication or other microfabrication techniques. For example, a hard mask may be utilized in conjunction with an aerosolized dry coating technique. In another example, a patterned coating could be applied to the layer of first luminescent particles 252 to form a mask thereon. Mask-less techniques may also be utilized, one example being the use of a patterned ground plate to deposit charged particles according to the pattern.

In the case of either the first or second luminescent particles 252, 254, the layer illustrated in FIG. 2 may actually represent two or more layers, which may be associated with two or more iterations of particle deposition. Each additional layer of first or second luminescent particles 252, 254 increases the thickness of that layer and the density of the luminescent particles 252, 254 in the overall layer. This in turn increases the number of interactions between the luminescent particles 252, 254 and an incident excitation light beam 140, and thus the amount of secondary emissions of the wavelength at which the luminescent particles 252, 254 fluoresce. This is another way of tailoring the contribution of a certain wavelength in the output light 170 of the lighting device 100.

As further illustrated in FIG. 2, in some implementations a coating 220 that is or includes a surface treatment (or surface modifier) chemistry (a "surface treatment coating") may be applied to the substrate surface 212 before depositing the first luminescent particles 252, or a surface treatment coating 224 may be applied to the first luminescent particles 252 before depositing the second luminescent particles 254, or both surface treatment coatings 220, 224 may be applied. The surface treatment coating 220, 224 may have a composition selected to control and improve adhesion, control wetting properties, and/or control pattern resolution (i.e., the pattern in which the particles are deposited on the underlying surface, as opposed to the pattern of sections 216 of particles). Examples of suitable surface treatment coatings 220, 224 include, but are not limited to, polyacrylates and polymers that can be deposited via chemical vapor deposition (CVD). In the case of a photoluminescent nanofiber (PLN) substrate, coatings that are optically transparent and do not expose the nanofibers to aggressive solvents that degrade the polymer fibers are acceptable. In more specific examples, poly(methyl methacrylate) (PMMA) and poly(lauryl methacrylate) (PLMA) have been found to be particularly suitable. The surface treatment coating 220, 224 may be deposited by any suitable technique. One or more of the deposition techniques noted above in conjunction with particle deposition may be suitable. The surface treatment coating 220, 224 may be deposited as a solution containing the component possessing the surface treating or modifying function (e.g., polyacrylates) and one or more suitable solvents such as, for example, toluene, hexane, etc. Non-fluorescent filler particles such as $TiO_2$, $SiO_2$, $Al_2O_3$ $CaCO_3$, bentonite and other clays may be utilized to increase the light reflectance and overall intensity of the PLN and control the degree of hide of the phosphor coating. Coatings of one or more materials, such as polyacrylate and/or parylene, may also be applied to the second luminescent particles 254.

Also in some implementations, the PLN composite 244 is partially or fully encapsulated by any transparent encapsulant 228 suitable for providing a protective barrier. Preferably, the encapsulant 228 is UV-insensitive and not prone to thermal degradation. Examples of encapsulants 228 include, but are not limited to, parylene, silicone (such as those available from Dow Corning of Midland, Mich.), and epoxies (such as those available from Norland Products of Cranbury, N.J.). The encapsulant 228 may be deposited by any suitable technique. One or more of the deposition techniques noted above in conjunction with particle deposition may be suitable.

Figure 3:
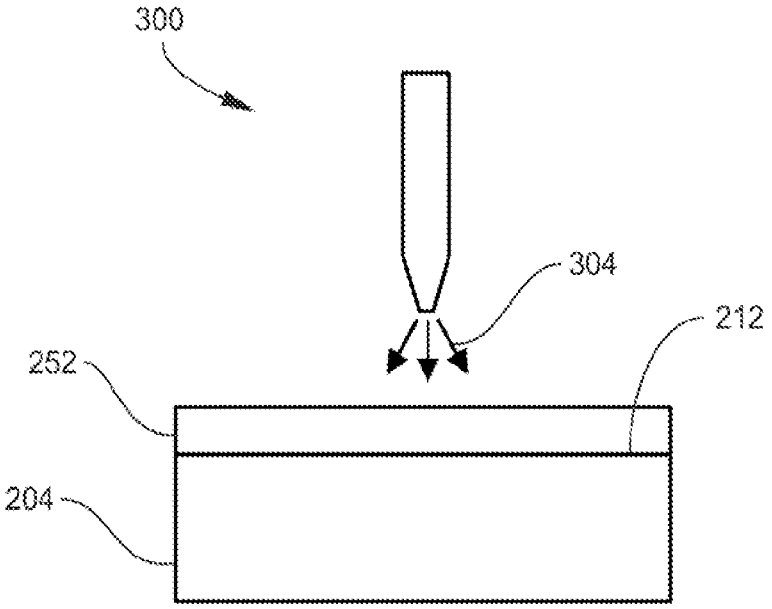
FIG. 3 is a schematic view of an example of a particle dispensing device being utilized to deposit a particle solution on a nanofiber substrate to form a PLN composite according to the present teachings.

FIG. 3 is a schematic view of an example of a particle dispensing device 300 being utilized to deposit a particle solution 304 on the nanofiber substrate 204 to form a layer of first luminescent particles 252 that spans the substrate surface 212. As noted above, the layer may be distinctive enough to result in a well defined interface between the layer and the nanofiber substrate 204, or some of the first luminescent particles 252 may penetrate into an upper region of the nanofiber substrate 204. As a further alternative, the first luminescent particles 252 may be incorporated with the nanofibers during formation of the nanofibers such as by extrusion or electropinning, as described further below.

Figure 4:
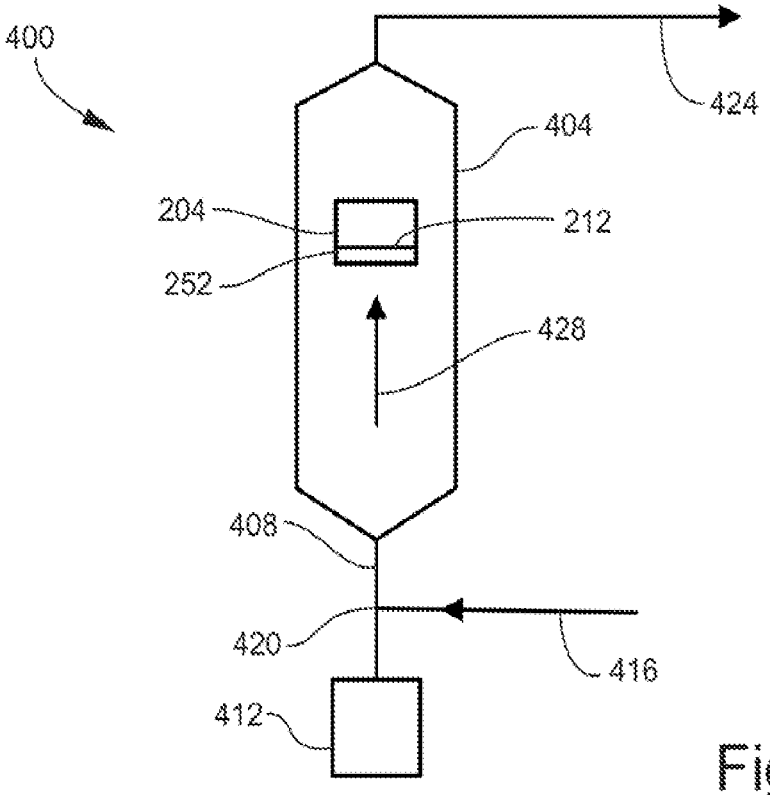
FIG. 4 is a schematic view of an example of an aerosol handling apparatus that may be utilized to deposit particles on a nanofiber substrate to form a PLN composite according to the present teachings.

FIG. 4 is a schematic view of an example of an aerosol handling apparatus 400 that may be utilized to deposit first luminescent particles 252 on the nanofiber substrate 204. In this example, the aerosol handling apparatus 400 includes a chamber 404 in which the nanofiber substrate 204 may be loaded and supported by any suitable means. An inlet conduit 408 provides fluid communication from a particle reservoir 412 to an inlet of the chamber 404. An air conduit 416 provides fluid communication from a source of air (not shown) to a Venturi valve 420 provided at the inlet conduit 408. An outlet conduit 424 provides fluid communication from an outlet of the chamber 404 to a suitable destination (not shown) for the process air. The outlet conduit 424 may communicate with an air pump (not shown) that provides vacuum and establishes a desired air flow rate (e.g., 10 liters per minute). By this configuration, particles from the particle reservoir 412 are drawn into the air flow at the Venturi valve 420 and particle-laden air 428 is directed to the nanofiber substrate 204. The nanofiber substrate 204 may act as a particle filter, allowing some air to pass while collecting particles at the substrate surface 212 to form a particle layer. To improve adhesion of the particles, a surface treatment coating as described above may be applied to the substrate surface 212 before loading the nanofiber substrate 202 into the chamber 404.

Figure 5:
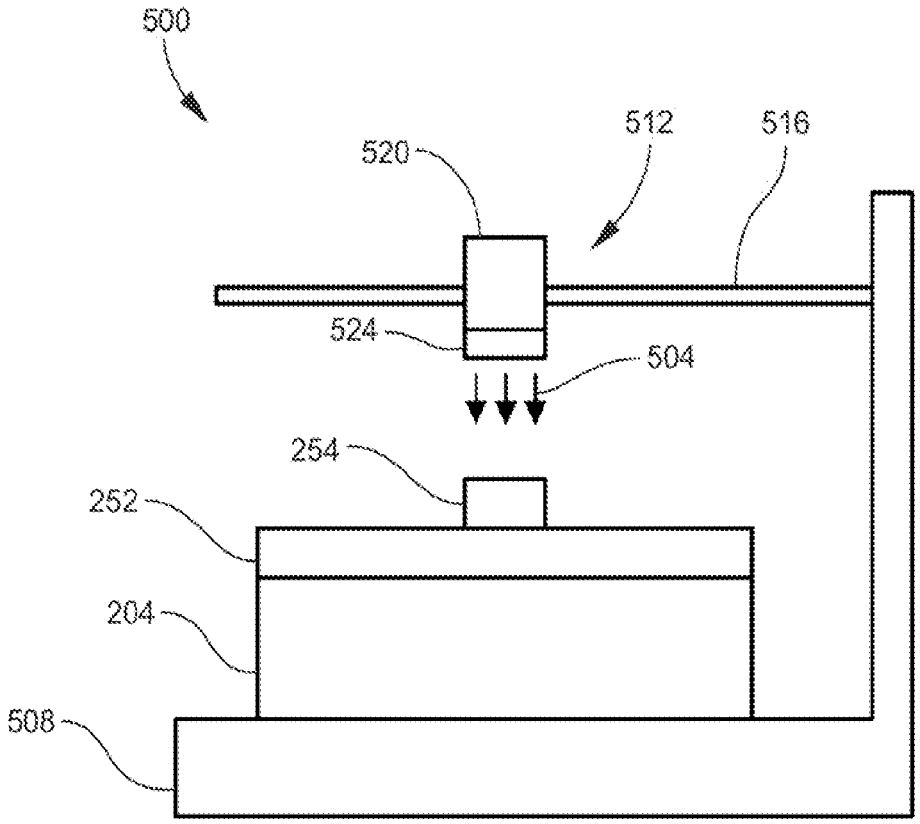
FIG. 5 is a schematic view of an example of an ink-jet printer being utilized to deposit a solution of particles on a PLN composite according to the present teachings.

FIG. 5 is a schematic view of an example of an ink jet printer 500 being utilized to deposit a solution 504 of second luminescent particles 254 on the nanofiber substrate 204/ layer of first luminescent particles 252. One example of a suitable ink-jet printer 500 is the Dimatix Materials Printer DMP-2800 commercially available from FUJIFILM Dimatix, Inc., Santa Clara, Calif. The ink jet printer 500 includes a frame 508 at which the nanofiber substrate 204 is mounted, a piezoelectric-driven ink-jet printhead 512, and an assembly 516 of mechanical and motorized components configured to move the printhead 512 in a controlled manner along one, two or three axes. The nanofiber substrate 204 may be mounted on a platen (not shown) of the frame 508 that is rotatable in a controlled manner. Either the frame 508 or the printhead 512 may allow adjustment of the vertical distance between the printhead 512 and the nanofiber substrate 204. The printhead 512 may include a reservoir 520 for the particle solution 504 and a bank of nozzles 524. The printhead 512 is configured to form a section of second luminescent particles 254 of an accurately controlled size and shape. Two or more sections of second luminescent particles 254 may be formed in a desired pattern such as that shown in FIG. 1A or other patterns described above. The particle solution 504 may have a desired concentration of particles in the solvent (e.g., in the mg/ml range, such as 40 or 80 mg/ml). Various deposition (printing) parameters may be controlled such as number of jets firing, drop firing velocity (e.g., in the m/s range, such as 7 or 9 m/s, drop firing waveform (e.g., in the Hz range, such as 5 Hz), drop space (e.g., in the micron range, such as 25 μm), and drop size (e.g., in the picoliter range), etc.

Figure 6:
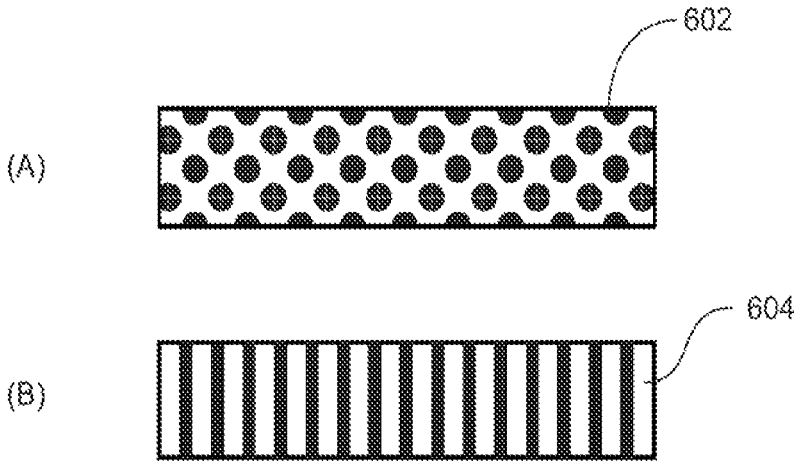
FIG. 6A is a plan view of an area of a surface on which particles have been deposited in one example of a deposition pattern according to the present teachings.
FIG. 6B is a plan view of an area of a surface on which particles have been deposited in another example of a deposition pattern according to the present teachings.
Figure 7:
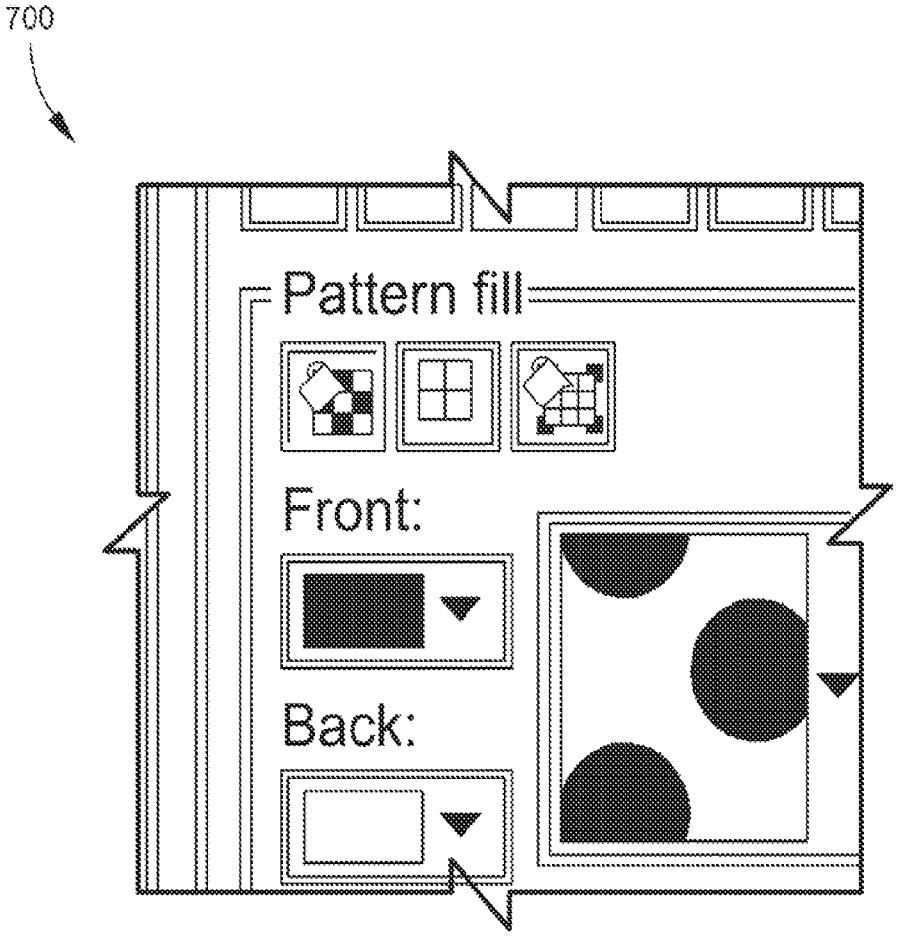
FIG. 7 is a view of a portion of a graphical user interface (GUI) of an example of a computer software program that may be utilized to control operational parameters associated with particle deposition, according to the present teachings.

In addition, the resolution at which the particle solution is printed and the deposition (printing) pattern may be controlled. This may be illustrated by the examples of FIGS. 6A and 6B, which are plan views of respective areas on which particles have been deposited in different patterns. Generally, particle solutions may be deposited in precisely metered aliquots or volumes, which may be characterized as deposition units. Each deposition unit may have a characteristic dimension (e.g., diameter, length, width, etc.) on the order of millimeters, microns, or fractions of an inch, and thus may contain a large quantity of particles. Moreover, the periodicity of or spacing between neighboring deposition units may also be controlled by controlling one or more of the above-noted deposition parameters, and may also be on the order of millimeters, microns, or fractions of an inch. The deposition units may have any shape such as, for example, stripes, lines, circles, dots, ellipses, diamonds, other polygons, etc. FIG. 6A illustrates deposition units 602 shaped as dots. In a few non-limiting examples, the dot diameter is 0.05 or 0.10 inch and the spacing between adjacent dots along a row or column is also about 0.05 or 0.10 inch. In some implementations, the deposition units are spaced from each other along at least one direction by a distance ranging from 0.01 to 1 inch. FIG. 6B illustrates deposition units 604 shaped as stripes or lines. Applying luminescent particles with a controlled resolution in this manner may be utilized to tightly control the end properties of the output light produced by a lighting device utilizing the PLN composite. A computer software program executed by hardware provided with or communicating with the ink-jet printer 500 may be utilized to control resolution and various other deposition parameters. This is illustrated in FIG. 7, which is a view of a portion of a graphical user interface (GUI) 700 of an example of such a computer software program.

Figure 8:
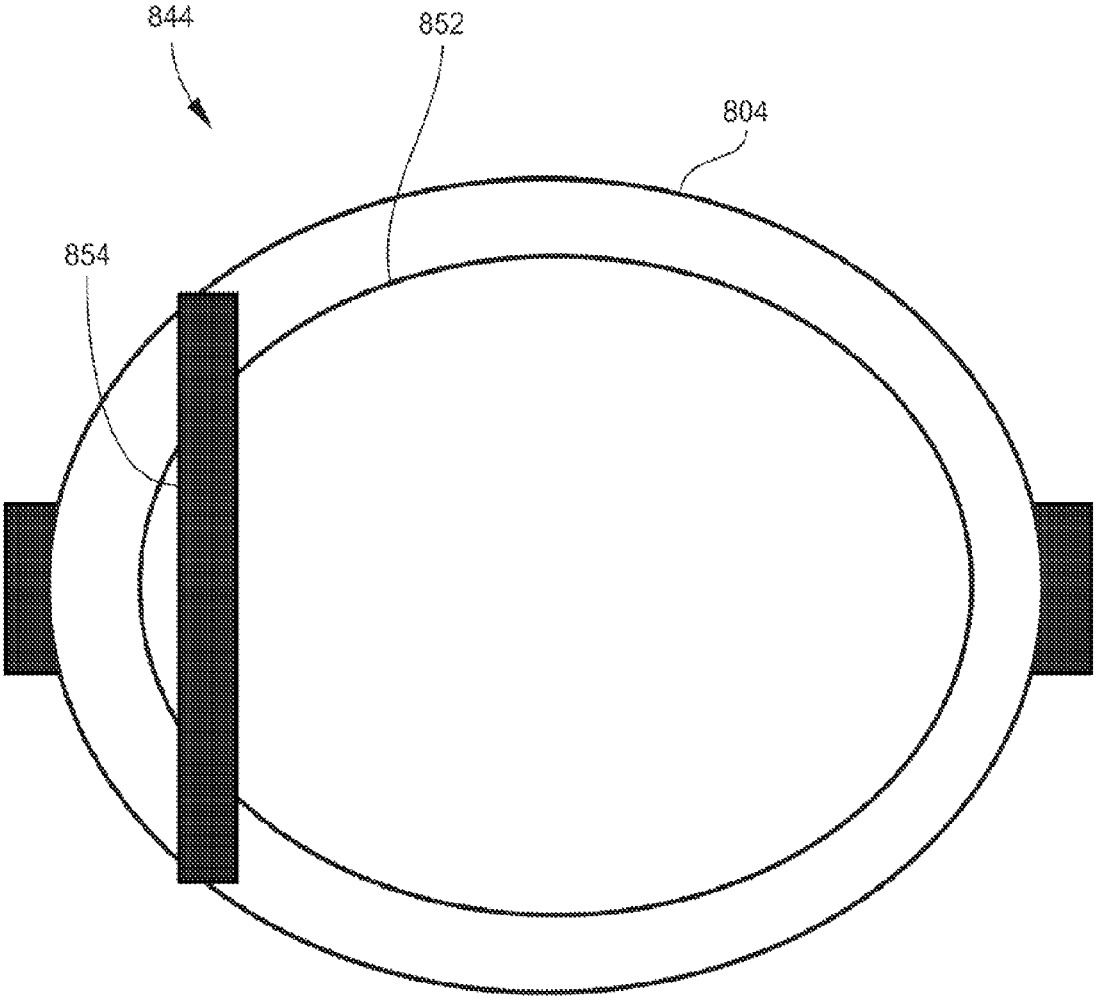
FIG. 8 is a plan view of another example of a PLN composite according to the present teachings.

FIG. 8 is a plan view of another example of a PLN composite 844. In the illustrated example, the PLN composite 844 includes a nanofiber substrate 804 and a pattern of two different luminescent materials 852, 854. For example, the first luminescent material 852 may be green emitting particles and the second luminescent material 854 may be red emitting particles. As a further example, the two luminescent materials 852, 854 may be different in kind as well as in spectral response, such as green emitting phosphors and red emitting QDs. The first luminescent material 852 covers a substantial portion of the nanofiber substrate 804, while the second luminescent material 854 covers only a single, limited area of the first luminescent material 852. The configuration of the section of second luminescent material 854 (e.g., location, size, shape, etc.) may be tailored to produce a desired color of white output light from an associated lighting device. This configuration may be determined in view of other design parameters of the lighting device (e.g., position of the light source, coherency and intensity of the light beam, configuration of the housing interior, etc.). Another attribute of the configuration is the number of layers of second luminescent material 854 deposited in the illustrated section. For example, in a case where the second luminescent material 854 is a red emitter, the decision to deposit additional layers of red emitters may be based on a desire to lower the CCT or increase the CRI of the output light.

Figure 9:
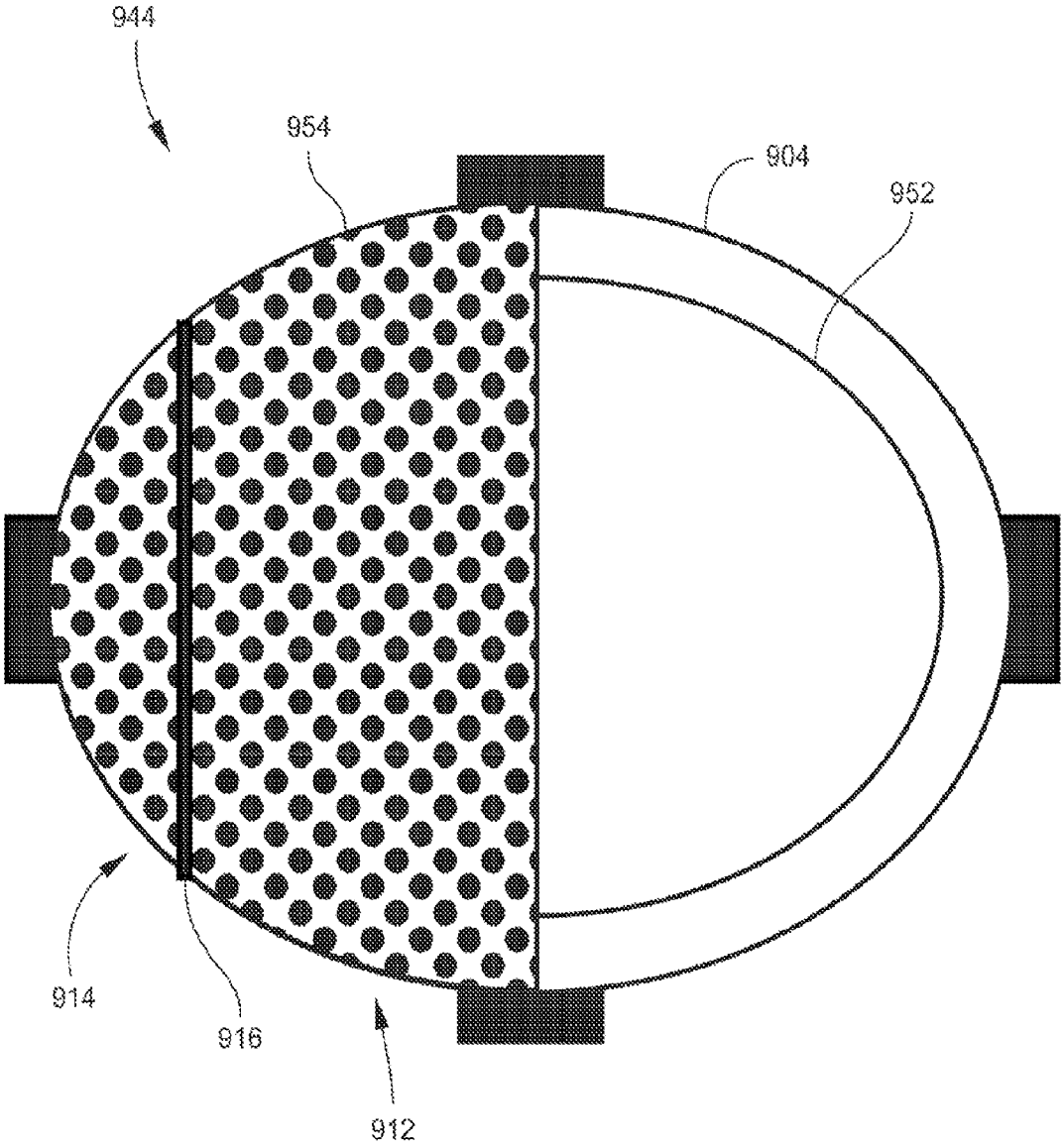
FIG. 9 is a plan view of another example of a PLN composite according to the present teachings.

FIG. 9 is a plan view of another example of a PLN composite 944. In the illustrated example, the PLN composite 944 includes a nanofiber substrate 904 and a pattern of two different luminescent materials 952, 954. The first luminescent material 952 covers a substantial portion of the nanofiber substrate 904. The second luminescent material 954 covers a smaller area that includes two sections 912, 914 distinguished by the number of layers of the second luminescent material 954. The two sections 912, 914 are demarcated in FIG. 9 by an imaginary line 916. In this example, two layers of the second luminescent material 954 cover 50% of the area of the PLN composite 944, and a third layer of the second luminescent material 954 covers 11% of the area of the PLN composite 944 which in FIG. 9 is the area to the left of the line 916. Thus, one section 912 of the second luminescent material 954 has two layers, while the other section 914 has three layers and thus a higher density of the second luminescent material 954. Also in this example, the second luminescent material 954 comprises particles deposited as a pattern of dots.

From the foregoing examples it will be appreciated that the selection of the pattern utilized for overprinting the second luminescent particles on the PLN composite—and the selection of the pattern (if any) made by sections of second luminescent particles in relation to first luminescent particles—may be based on the color of white light desired to be produced by the lighting device to be equipped with the PLN composite. As noted earlier in this disclosure, the color of white light may be defined or described in terms of one or more color parameters such as SPD, CCT, CRI, chromaticity coordinates, and distance from Planckian locus. For example, the pattern utilized to produce a neutral white color (e.g., CCT=4,500 K) may be different from the pattern utilized to produce a warm white color (e.g., CCT=2,700 K). The color of the output light is dependent on the spatial distribution of the primary light as well as the density of the first luminescent particles, the density of the overprinted second luminescent particles, and the resulting pattern on the nanofiber substrate. Hence the selection of the pattern (size, shape, periodicity, etc.), particle characteristics, and number of layers of particles (particularly the second luminescent particles) drives the characteristics of the lighting device in lighting applications.

Figure 10:
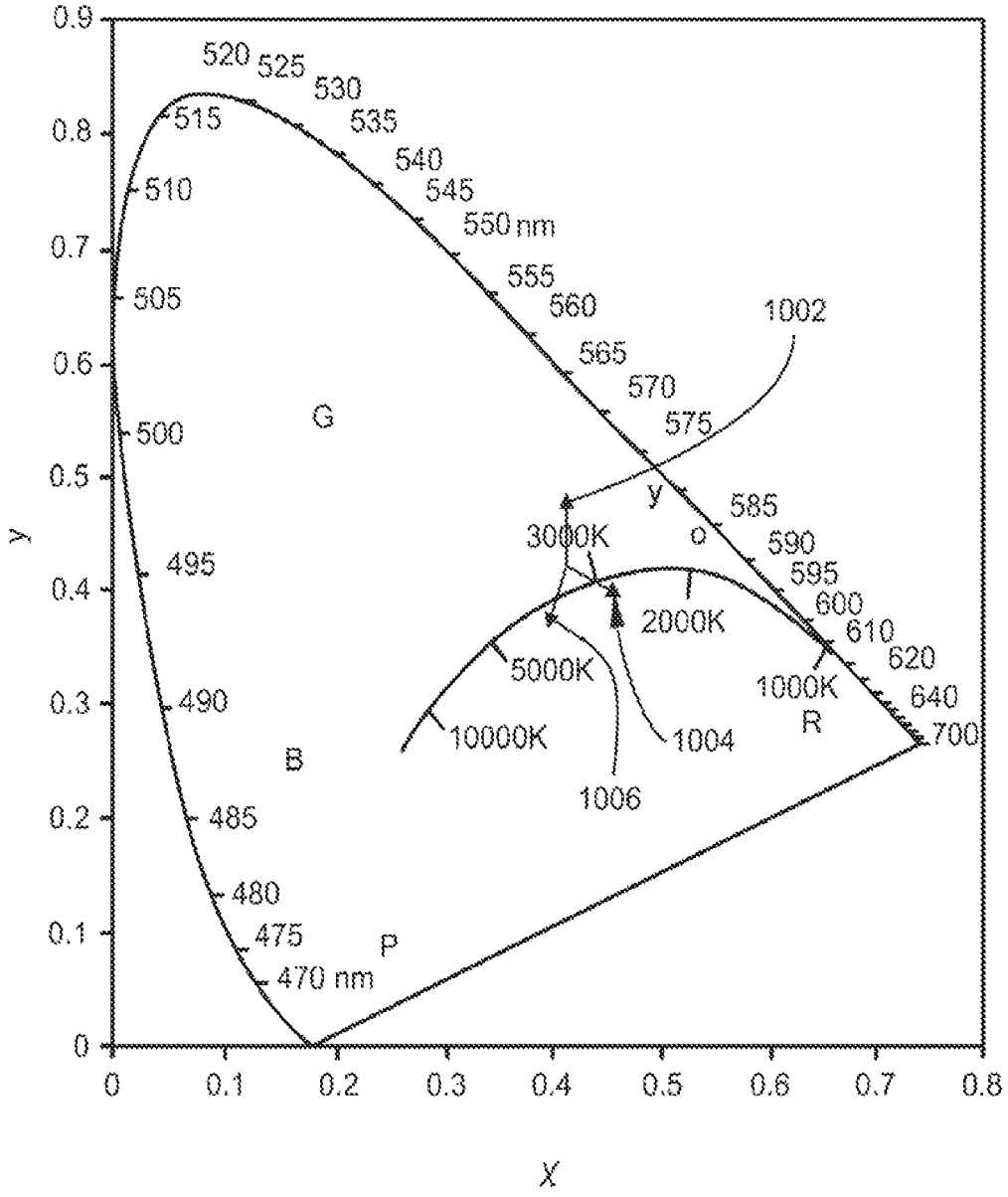
FIG. 10 is a representation of a CIE 1931 (x, y) chromaticity diagram illustrating how fabricating a PLN composite according to implementations disclosed herein can affect the color of the output light produced by a lighting device utilizing the PLN composite.

FIG. 10 is a representation of a CIE 1931 (x, y) chromaticity diagram illustrating how fabricating a PLN composite according to implementations disclosed herein can affect the color of the output light produced by a lighting device utilizing the PLN composite. As appreciated by persons skilled in the art, the color space is bounded by the curved spectral locus shown in FIG. 10, which is indexed by wavelengths given in nanometers, and by the straight line that interconnects the two ends of the spectral locus. Red, green, blue, yellow, orange and purple regions of the color space are generally designated R, G, B, Y, O and P, respectively. The curved line in the color space is the Plankian locus, which is indexed by CCT values. For simplicity, isotherms (or lines of constant CCT) crossing the Plankian locus are not shown.

An arrow 1002 in FIG. 10 illustrates the impact of adding a green-emitting material to the PLN composite (e.g., adding layers of green-emitting material, increasing the concentration of green-emitting material deposited, increasing the area of green-emitting material to be targeted by an excitation light beam, etc.). Increasing green emission typically results in increasing the y chromaticity coordinate of the resultant output light of the lighting device. Another arrow 1004 illustrates the impact of adding a red-emitting material to the PLN composite. Increasing red emission decreases CCT and increases the x chromaticity coordinate. Another arrow 1006 illustrates the impact of adding a reflective material such as a white material to the PLN composite in a case where the light source is a blue emitter. Equivalently, the arrow 1006 illustrates the impact of adding a blue-emitting material responsive to a short-wavelength (UV or violet) light source. Either case increases blue emission, which increases CCT and decreases the x chromaticity coordinate. Various configurations entailing the use of two or more different types of luminescent materials and different patterns may be implemented to produce various other color tuning effects intermediate to the three examples just described. For a given configuration of a lighting device, the configuration of the luminescent materials of the PLN composite can be selected so as to move the properties of the output light toward the Plankian locus, which allows greater control over CCT, CRI, and (x,y) values. Movement of the chromaticity toward the Plankian locus may entail increasing or decreasing the x chromaticity coordinate and/or increasing or decreasing they chromaticity coordinate.

When evaluating the impact of a given configuration of the PLN composite, SPD data may be acquired and utilized to calculate CRI, CCT, chromaticity coordinates, and/or distance from Plankian locus. Spectral measurements may be acquired by utilizing, for example, a spectroradiometer or a tristimulus colorimeter. The calculations may be done according to predefined standards or guidelines such as those promulgated by CIE or other entities, or according to a manufacturer's specifications, a customer's requirements, or a user's preference. Some or all calculations may be done by executing one or more different types of computer software programs. Moreover, the PLN composite may be configured so as to yield a specific, desired value of one or more color parameters. The desired value may fall within a range of values deemed acceptable for the color sought for the output light of a lighting device being manufactured. For example, the range may be a range of error or tolerance about a single desired value of a given color parameter (e.g., ±1%).

Figure 11A:
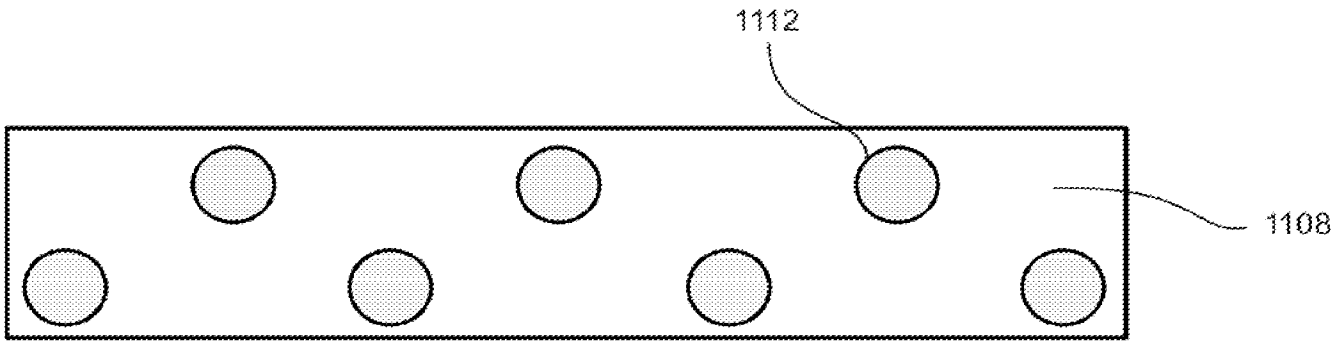
FIG. 11A is a schematic view of an example of a particle-supporting fiber according to the present teachings.
Figure 11B:
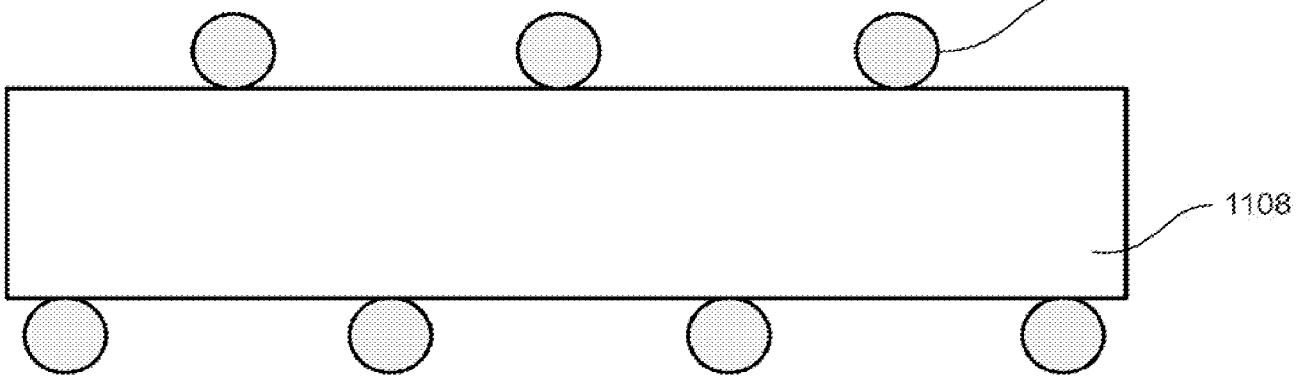
FIG. 11B is a schematic view of another example of a particle-supporting fiber according to the present teachings.

As described above, in advantageous implementations the PLN composites are based on nanofiber substrates formed from a plurality of nanofibers. FIGS. 11A and 11B are schematic views of a nanofiber 1108 or portion thereof. A plurality of such nanofibers 1108 may be collected and formed into a nanofiber substrate. In some implementations, luminescent (or luminescent and reflective) particles may thereafter be applied to the nanofiber substrate in layers and/or sections as described above. Some particles 1112 may be supported directly on outer surfaces of the nanofibers 1108 as shown in FIG. 11B. In such implementations, these nanofibers 1108 may be located at the substrate surface or also in an upper region of the nanofiber substrate. In some implementations, the average diameter of the luminescent particles 1112 is smaller than the average diameter of the nanofiber 1108.

In alternative implementations, certain particles 1112 (particularly the first luminescent particles that form a base PLN composite) may be added to the nanofiber precursor and thus included with the as-formed nanofibers 1108. In these implementations, FIG. 11A illustrates a case in which particles 1112 are disposed in the bulk of the nanofiber 1108, and FIG. 11B illustrates a case in which particles 1112 are disposed on the nanofiber 1108. In the present context, an arrangement of particles 1112 "disposed on" the nanofiber 1108 encompasses particles 1112 disposed on an outer surface of the nanofiber 1108, and/or particles 1112 disposed at least partially in an outer region of the nanofiber 1108 and protruding from the outer surface. When the particles 1112 are luminescent and supported directly by nanofibers 1108 as illustrated in FIG. 11A or 11B, the resulting fibers may be referred to as luminescent fibers or light-stimulable fibers.

Figure 12:
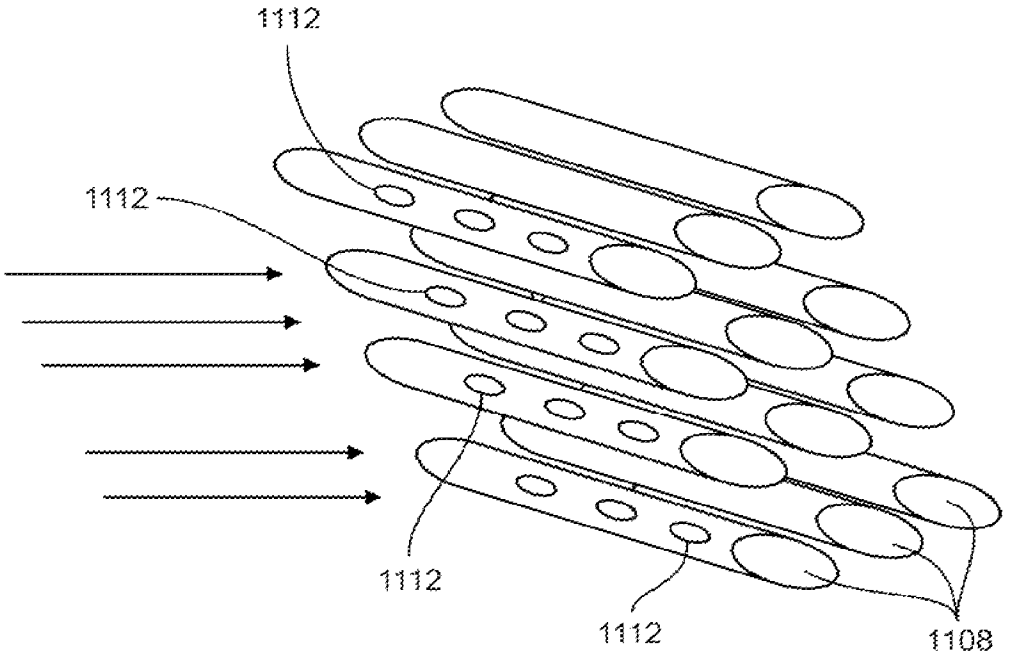
FIG. 12 is a schematic view of a nanofiber substrate formed with the luminescent fibers illustrated in FIG. 11A and/or FIG. 11B, according to the present teachings.

FIG. 12 is a schematic view of an example of a nanofiber substrate 1200 (or portion of a nanofiber substrate 1200) formed from a plurality of nanofibers 1108. The nanofiber substrate 1200 may be structured as a nonwoven mat. In some implementations, the nanofiber substrate 1200 may be considered as including one or more layers of nanofibers 1108. When utilized as a PLN composite, the nanofiber substrate 1200 may support one or more layers of particles and/or may include luminescent fibers structured as shown in either FIG. 11A or FIG. 11B or a combination of both types of luminescent fibers shown in FIG. 11A and FIG. 11B.

As a bulk property, the nanofiber substrate 1200 may be considered to function as an optical scattering center for incident light. Light scattering from the nanofibers 1108 is believed to depend on the wavelength λ of the light, the diameter of the nanofibers 1108, the orientation of the nanofibers 1108 relative to the incident light, the surface morphology of the nanofibers 1108, and the refractive index of the nanofibers 1108. In some implementations, polymer nanofibers 1108 have refractive indices ranging from 1.3 to 1.6. Incident light may be scattered by the nanofibers 1108 and interact with particles 1112 supported by the nanofiber substrate 1200 or incorporated with the nanofibers 1108. Each nanofiber 1108 may provide an individual scattering site for light incident thereon. Moreover, the nanofiber substrate 1200 may serve as a medium for effectively (and temporarily) capturing, trapping or confining photons of the incident light. These attributes increase the probability of interaction between the particles 1112 and incident light. Hence, the PLN composites taught herein more efficiently capture excitation photons and re-radiate photons at visible wavelengths with higher intensities than would be possible with conventional, non-fibrous light converters. The superior performance of the nanofiber substrate 1200 over a comparative polymer solid film—both samples containing a uniform dispersion of the same type of luminescent QDs and an equal number of QDs—has been verified by testing as disclosed in U.S. Patent Application Pub. No. 2008/0113214.

In some examples, the nanofibers 1108 of the nanofiber substrate 1200 may have an average fiber diameter ranging from 10 to 5,000 nm; in other examples ranging from 100 to 2,000 nm; in other examples ranging from 300 to 2,000 nm; and in other examples ranging from 400 to 1,000 nm. The nanofibers 1108 may be fabricated such that their average fiber diameter is comparable to a wavelength λ, of interest, such as that of the primary light emitted from a light source intended to irradiate the nanofiber substrate 1200. Sizing the nanofibers 1108 in this manner helps to provide scattering sites within the structure of the nanofiber substrate 1200 for the primary light or other wavelength λ, of interest. For example, the wavelength λ of interest may range from 100 to 2,000 nm, or in a more specific example may range from 400 to 500 nm (e.g., a blue-emitting light source), or may fall within the shorter wavelength ranges corresponding to violet and UV light sources. The nanofiber substrate 1200 may be more effective in capturing photons having the shorter wavelengths typically utilized for excitation in that, on average, shorter-wavelength light may propagate through the nanofiber substrate 1200 over a longer optical path length (OPL).

For example, a typical excitation wavelength is blue light at 450 nm. To produce white light, the lighting device would need to emit radiation over a broad range of wavelengths, for example from 450 nm to 750 nm. By fabricating a nanofiber substrate 1200 in which the average diameter of the nanofibers 1108 is roughly the same as that of the excitation wavelength (e.g., 450 nm), the excitation light can be effectively trapped in the structure of the nanofiber substrate 1200 by light scattering (i.e., the OPL of the excitation light is long). This increases the likelihood that the excitation source will initiate fluorescence of the luminescent particles 1112 on or in the nanofiber substrate 1200 sufficient to cause the lighting device to produce white light that is uniform and has a balanced spectral power distribution. In contrast to the excitation light, the longer wavelength emissions produced by fluorescence may be scattered less effectively by the nanofibers 1108 and thus be more likely to emerge from the nanofiber substrate 1200 with minimal scattering. Under these conditions, the light scattering/photonic properties as a function of wavelength and fiber diameter are improved.

Figure 13:
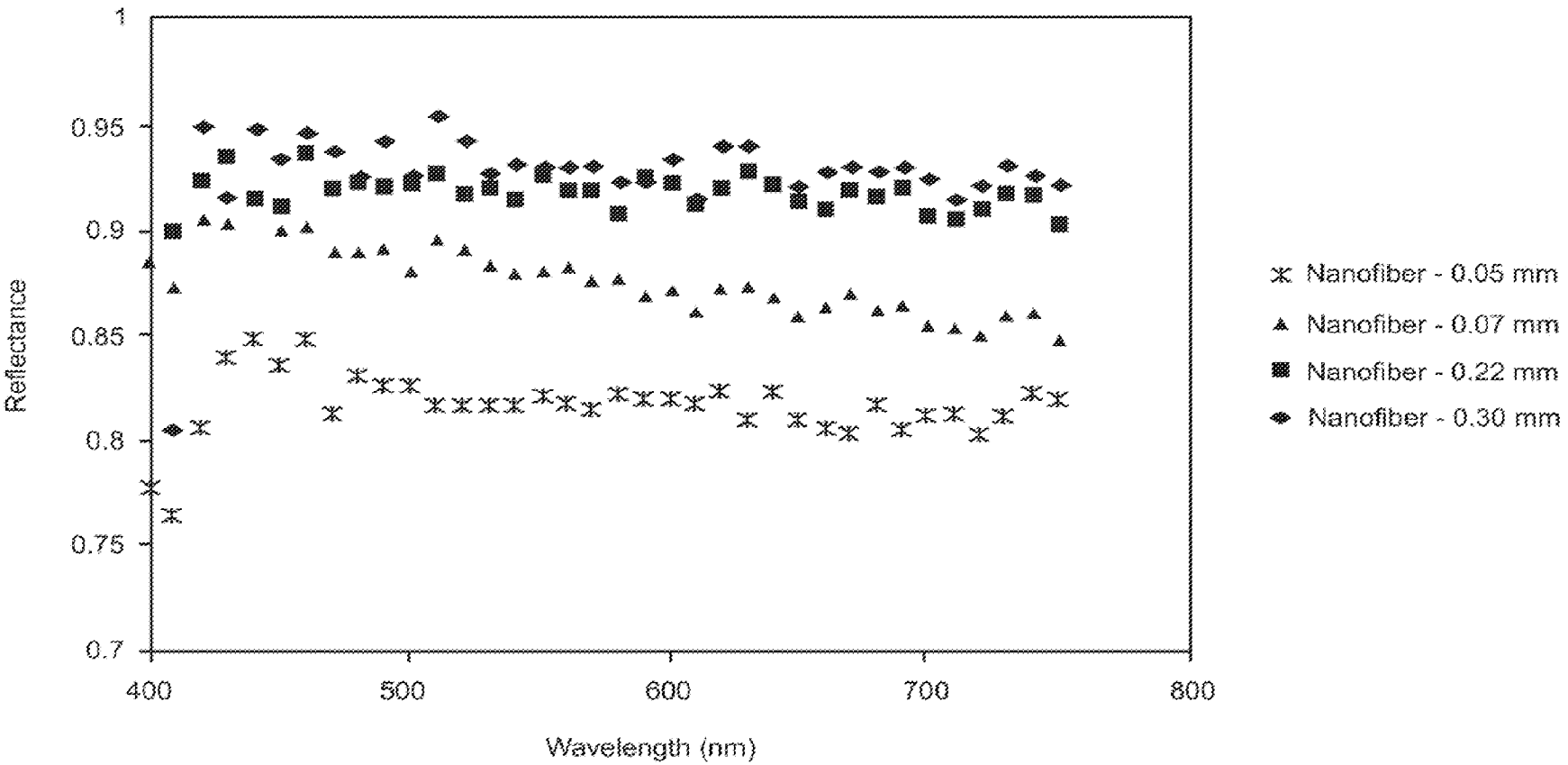
FIG. 13 provides reflectance data measured as a function of wavelength for four samples of nanofiber substrates of different thicknesses fabricated according to the present teachings.

Additionally, the thickness of the nanofiber substrate 1200 may be selected to control the degree to which the nanofiber substrate 1200 is reflective of or (partially) transparent to light at wavelengths of interest. Generally, increasing thickness increases reflectivity and decreasing thickness increases transparency. In some examples, the thickness of the nanofiber substrate 1200 ranges from 0.1 to 2,000 μm. Thicknesses below 0.1 μm or above 2,000 μm are also encompassed by the present teachings, although an overly thin substrate 1200 may not be as effective at capturing incident excitation light while an overly thick substrate 1200 may promote too much scattering away from the particles 1112. In other examples, the thickness of the nanofiber substrate 1200 ranges from 1 to 500 μm. In some implementations, a thickness of greater than 5 μm will render the nanofiber substrate 1200 sufficiently diffusively reflective of light over the range of visible wavelengths processed by the lighting devices taught herein (i.e., primary light and secondary light). In some examples, the nanofiber substrate 1200 reflects greater than 80% of visible light. In other examples, the nanofiber substrate 1200 reflects greater than 90% of visible light, and may reflect almost 100% of visible light. FIG. 13 provides reflectance data measured as a function of wavelength for four samples of nanofiber substrates of different thicknesses (0.05 mm, 0.07 mm, 0.22 mm, and 0.30 mm). FIG. 13 demonstrates that reflectance of relatively thick nanofiber substrates may approach or exceed 95% over a broad spectrum of wavelengths. On the other hand, at thicknesses less than 5 μm the nanofiber substrate 1200 may be transparent to visible light of various wavelengths to an appreciable degree.

The nanofiber substrate 1200 may be fabricated by a variety of techniques. In some implementations, the method entails forming nanofibers 1108 of a controlled diameter by a technique such as electrospinning, extrusion, drawing, melt blowing, splitting/dissolving of bicomponent fibers, phase separation, solution spinning, flash spinning, template synthesis, or self-assembly. The method for fabricating the nanofiber substrate 1200 may be included as part of the methods for fabricating PLN composites described herein.

In some advantageous implementations, the nanofibers 1108 are formed by an electrospinning technique. As appreciated by persons skilled in the art, a typical electrospinning apparatus may generally include a source (e.g., reservoir) of a polymer solution or melt utilized as a precursor to the nanofibers 1108. Various mixtures of polymers, solvents and additives may be utilized. The solvents may be organic or inorganic. Examples of solvents include, but are not limited to, distilled water, dimethylformamide, acetic acid, formic acid, dimethyl acetamide, toluene, methylene chloride, acetone, dichloromethane, combinations of the foregoing, one or more of the foregoing in combination with other solvents, or other suitable solvents. Additives may include viscosifiers, surfactants and the like. The polymer solution is flowed by any suitable means (e.g., a pump) to an electrospinning element (e.g., a head, needle, etc.). A positive electrode of a high-voltage power supply may be connected to the tip of the electrospinning element. The electrospinning element may be positioned at a specified distance from a metallic collector plate, which typically is electrically grounded. The electrospinning element and the collector plate may be located in a chamber configured to enable control over various processing conditions such as composition of gases, partial pressures, temperature, electrical field distribution, etc. With flow of the polymer solution at a specified flow rate established to the electrospinning element and a voltage of a specified magnitude applied to the electrospinning element, polymer nanofibers are drawn from the electrospinning element and accumulate as a nonwoven substrate on the collector plate. As appreciated by persons skilled in the art, the optimum operating parameters of the electrospinning apparatus (e.g., flow rate, voltage, distance between electrospinning element and collector plate, etc.) will depend on the composition of the nanofibers to be produced.

The general design, theory and operation of this type of electrospinning apparatus is known to persons skilled in the art and thus need not be described in detail herein. Some examples of suitable electrospinning apparatus and associated electrospinning-based techniques for forming nanofibers include those disclosed in U.S. Patent Application Pub. No. 2005/0224998; U.S. Patent Application Pub. No. 2005/0224999; U.S. Patent Application Pub. No. 2006/0228435; U.S. Patent Application Pub. No. 2006/0264140; U.S. Patent Application Pub. No. 2008/0110342; U.S. Patent Application Pub. No. 2008/0113214; International Pub. No. WO 2009/032378; and PCT Application No. PCT/US2010/031058.

In some implementations, electrospinning or other fiber-forming techniques may be utilized to produce a nanofiber substrate 1200 containing fibers of two or more average diameters. Fibers of different diameters may be mixed throughout the bulk of the nanofiber substrate 1200, or larger-diameter fibers may be located at one face of the nanofiber substrate 1200 while smaller-diameters are located at the opposite face. Fiber diameter may be graded through the thickness of the nanofiber substrate 1200.

In typical implementations, the nanofibers 1108 of the nanofiber substrate 1200 are polymers. Examples of suitable polymers include, but are not limited to, acrylonitrile/butadiene copolymer, cellulose, cellulose acetate, chitosan, collagen, DNA, fibrinogen, fibronectin, nylon, poly(acrylic acid), poly(chloro styrene), poly(dimethyl siloxane), poly (ether imide), poly(ether sulfone), poly(ethyl acrylate), poly (ethyl vinyl acetate), poly(ethyl-co-vinyl acetate), poly(ethylene oxide), poly(ethylene terephthalate), poly(lactic acid-co-glycolic acid), poly(methacrylic acid) salt, poly(methyl methacrylate), poly(methyl styrene), poly(styrene sulfonic acid) salt, poly(styrene sulfonyl fluoride), poly(styrene-co-acrylonitrile), poly(styrene-co-butadiene), poly(styrene-co-divinyl benzene), poly(vinyl acetate), poly(vinyl alcohol), poly(vinyl chloride), poly(vinylidene fluoride), polyacrylamide, polyacrylonitrile, polyamide, polyaniline, polybenzimidazole, polycaprolactone, polycarbonate, poly(dimethylsiloxane-co-polyethyleneoxide), poly(etheretherketone), polyethylene, polyethyleneimine, polyimide, polyisoprene, polylactide, polypropylene, polystyrene, polysulfone, polyurethane, poly(vinylpyrrolidone), proteins, SEBS copolymer, silk, and styrene/isoprene copolymer.

Additionally, the nanofibers 1108 may include a polymer blend. If electrospinning is to be implemented, the two or more polymers should be soluble in a common solvent or in a system of two or more appropriately selected solvents. Examples of suitable polymer blends include, but are not limited to, poly(vinylidene fluoride)-blend-poly(methyl methacrylate), polystyrene-blend-poly(vinylmethylether), poly(methyl methacrylate)-blend-poly(ethyleneoxide), poly (hydroxypropyl methacrylate)-blend-poly(vinylpyrrolidone), poly(hydroxybutyrate)-blend-poly(ethylene oxide), protein-blend-polyethyleneoxide, polylactide-blend-polyvinylpyrrolidone, polystyrene-blend-polyester, polyester-blend-poly(hyroxyethyl methacrylate), poly(ethylene oxide)-blend-poly(methyl methacrylate), and poly(hydroxystyrene)-blend-poly(ethylene oxide).

As noted above, in some implementations the first luminescent particles utilized to form the base PLN may be provided with the nanofibers 1108 prior to the nanofiber substrate 1200 being formed. In one implementation, the particles 1112 may be applied (added) to the polymer solution supplied to the electrospinning apparatus and thus are discharged with the polymer matrix during electrospinning. The ratio of polymer to luminescent compound in the solution may typically range from 2:1 to 100:1. The large surface area of the nanofibers 1108 may be sufficient to prevent agglomeration of the particles 1112, although additional steps may be taken to inhibit agglomeration such as including de-agglomerating additives in the polymer/particle matrix, or other techniques disclosed in one or more of the references cited in the present disclosure. In another implementation, the particles 1112 are applied to an as-forming nanofiber (which at this stage may be in the form of a liquid jet, filament, proto-fiber, etc.) while the nanofiber is being electrospun and/or coalescing into a resultant fiber mat or substrate 1200. In this case, the particles 1112 may be transported to the as-forming nanofibers before they are dried by any suitable technique. In one advantageous implementation, a particle-inclusive solution is discharged from an electrospray apparatus positioned between the elecrospinning element and the collector plate. The position of the electrospay apparatus may be selected to control the extent of penetration of the particles 1112 into the nanofiber 1108, thereby dictating whether the particles 1112 become embedded in the bulk of the nanofiber 1108 (e.g., FIG. 11A) or disposed on the outer surface of the nanofiber 1108 (e.g., FIG. 11B). The electrospray apparatus may be effective in inhibiting agglomeration of the particles 1112.

In other implementations, the particles 1112 are applied after electrospinning, i.e., after the nanofibers 1108 have been formed into a nanofiber substrate 1200, by the various coating, printing and other methods described earlier in the present disclosure.

As noted previously, the particles 1112 may be luminescent particles such as QDs, phosphors, nano-phosphors, organic dyes, or combinations of two or more of the foregoing. Reflective particles may also be included, such as barium sulfate, titanium (IV) oxide, alumina, zinc oxide, Teflon®, and combinations of two or more of the foregoing.

Examples of light-emitting QDs include, but are not limited to, silicon, germanium, indium phosphide, indium gallium phosphide, cadmium sulfide, cadmium selenide, lead sulfide, copper oxide, copper selenide, gallium phosphide, mercury sulfide, mercury selenide, zirconium oxide, zinc oxide, zinc sulfide, zinc selenide, zinc silicate, titanium sulfide, titanium oxide, and tin oxide. In certain specific examples, QDs found to be particularly suitable include CdSe, InGaP, InP, GaP, and ZnSe. More generally, the QDs are typically composed of inorganic semiconductor materials selected from various Group II-VI, Group Group III-V, Group IV, Group IV-VI, and Group V-VI materials. For some implementations, the QDs utilized may be selected from a class specified as being heavy metal-free (or restricted metal-free) QDs. Heavy metal-free QDs do not include heavy metals such as cadmium, mercury, lead, hexavalent chromium, or the like.

As other examples, QDs having the following compositions may be found to produce suitable secondary emissions of desired wavelengths in response to excitation of primary light of the wavelengths contemplated herein: Group II-VI materials such as ZnS, ZnSe, ZnTe, ZnO, CdS, CdSe, CdTe, CdO, HgS, HgSe, HgTe, HgO, MgS, MgSe, MgTe, MgO, CaS, CaSe, CaTe, CaO, SrS, SrSe, SrTe, SrO, BaS, BaSe, BaTe, and BaO; Group materials such as $CuInS_2$, $Cu(In,Ga)S_2$, $CuInSe_2$, and $Cu(In,Ga)Se_2$; Group III-V materials such as AlN, AlP, AlAs, AlSb, GaN, GaP, GaAs, GaSb, InN, InP, InAs, and InSb; Group IV materials such as Si, Ge, and C; Group IV-VI materials such as GeSe, PbS, PbSe, PbTe, PbO, SnSe, SnTe, and SnS; and Group V-VI materials such as $Sb_2Te_3$, $Bi_2Te_3$, and $Bi_2Se_3$. Transition metal compounds such as the oxides, sulfides, and phosphides of Fe, Ni, and Cu may also be applicable. Examples of QDs further encompass binary, ternary, quaternary, etc. alloys or compounds that include the foregoing species (e.g., SiGe, InGaAs, InGaN, InGaAsP, AlInGaP, etc.). Other QDs may include other types of semiconducting materials (e.g., certain organic and polymeric materials). For a QD having a core-shell structure, the shell may be composed of one of the foregoing species or other species, and the respective compositions of the core and the shell may be different. An example of a core-shell composition is CdSe—ZnS capped with organic ligands such as trioctylphosphine oxide (TOPO). Such core-shell structures are commercially available from Evident Technologies, Inc., Troy, N.Y.

As appreciated by persons skilled in the art, the composition selected for the QDs may be based on a desired property such as band gap energy or wavelength sensitivity. Moreover, the size or shape of the QDs may be selected to absorb or emit a desired wavelength of electromagnetic radiation when integrated with a nanofiber substrate or applied as a layer to other types of substrates. Generally for a given species of QD below a critical size, smaller sizes have larger band gaps and emit radiation at shorter (bluer) wavelengths while larger sizes have smaller band gaps and emit radiation at longer (redder) wavelengths. For example, CdSe nanoparticles of 2.8 nm nominal diameter emit green light at roughly 530 nm, whereas CdSe nanoparticles of 5.0 nm nominal diameter emit red light at roughly 625 nm. Additionally, the QDs utilized may include QDs of two or more different species (compositions) and/or two or more different specific sizes, as for example when fabricating a pattern of different PL materials. For example, a mixture or pattern of two or more different QDs may be selected so that the QDs emit different bands of visible electromagnetic radiation. Alternatively or additionally, more than one distinct QD layer or region of QDs may be provided, each having a different composition or size of QDs.

The QDs may be formed by various known techniques such as, for example, colloidal synthesis, plasma synthesis, vapor deposition, epitaxial growth, and nanolithography. The size, size distribution, shape, surface chemistry or other attributes of the QDs may be engineered or tuned to have desired properties (e.g., photon absorption and/or emission) by any suitable technique now known or later developed. In some implementations, QDs are provided in a solution of an organic carrier solvent such as anisole, octane, hexane, toluene, butylamine, etc., or in water, and with or without a matrix or host material, and are deposited to a desired thickness by any of the techniques disclosed herein. Alternatively, the QDs may be dispersed to a desired density or concentration in a matrix material, which may be composed of a polymer, sol-gel or other material that can easily form a film on the underlying target surface. Generally, the matrix material selected is one that does not impair luminescence or other desired performance parameters of the QDs.

Examples of phosphors and nano-phosphors include, but are not limited to, the following groups:

1. Rare-earth doped metal oxides such as $Y_2O_3$:Tb, $Y_2O_3$:$Eu^{3+}$, $Lu_2O_3$:$Eu^{3+}$, $CaTiO_3$:$Pr^{3+}$, CaO:$Er^{3+}$, (GdZn)O:$Eu^{3+}$, $Sr_4Al_{14}O_{25}$:$Eu^{3+}$, $GdMbB_3O_{10}$:$Ce^{3+}$:$Tb^{3+}$, and $CeMgAl_{11}O_{19}$:$Ce^{3+}$:$Tb^{3+}$;

2. Metal sulfides such as CaS:$Eu^{2+}$, $SrGa_2S_4$:Eu, and $Ca_{w-}Sr_xGa_y(S,Se)_z$:Eu such as those described in U.S. Pat. No. 6,982,045 and commercially available from PhosphorTech (Lithia Springs, Ga.);

3. Rare-Earth doped yttrium aluminum garnet (YAG) such as YAG:$Ce^{3+}$;

4. Metal silicates such as $Ca_3(Sc,Mg)_2Si_3O_{12}$:Ce and $(Ba,Sr)_2SiO_4$:Eu, and rare-Earth doped silicates including Eu-doped silicates;

5. Rare-earth doped zirconium oxide such as $ZrO_2$:$Sm^{3+}$ and $ZrO_2$:$Er^{3+}$;

6. Rare-earth doped vanadate ($YVO_4$:Eu) and phosphate (La, Ce,Tb)$PO_4$;

7. Doped materials consisting of a host matrix (e.g., $Gd_2O_3$, $GdO_2S$, PbO, ZnO, ZnS, ZnSe) and a dopant (Eu, Tb, Tm, Cu, Al and Mn); and 8. Metal-doped forms of zinc sulfide and zinc selenide (e.g., ZnS:$Mn^{2+}$, ZnS:$Cu^{+}$, $Zn_{0.25}Cd_{0.75}S$:AgCl).

Other examples of phosphors that may be suitable may be found in W. M. Yen, S. Shionoya, and H. Yamamoto, *Phosphor Handbook*, Second Ed., the entire contents of which are incorporated by reference herein. In certain specific examples, phosphors found to be particularly suitable include rare-earth doped YAG, doped metal sulfides including doped ZnS and doped $SrGa_2S_4$, and doped ZnSe.

Phosphors are typically provided in aqueous dispersions and may include a polymeric binder as well as any of the additives noted above. Generally, phosphors may be applied to underlying substrates or particle layers by employing the same coating, printing and other techniques as for QDs.

Examples of organic dyes include, but are not limited to, various proteins and small molecules that exhibit fluorescence; fluorophores, such as resonance dyes like fluoresceins, rhodamines; most 4,4'-difluoro-4-bora-3a,4a-diaza-s-indacenes (BODIPY dyes); most cyanines; and charge transfer dyes (emission from intramolecular charge transfer transitions) such as coumarins.

As described above, a PLN composite as taught herein may include a combination (e.g., a blend, pattern, etc.) of QDs, phosphors, nano-phosphors and/or dyes, including a distribution of different sized particles of one or more of the foregoing classes of luminescent materials, to provide secondary emission of two or more different wavelengths. For instance, a PLN composite may include green-emitting phosphors and red-emitting QDs. A combination of luminescent particles may be selected such that, in further combination with the wavelength of the portion of the primary light emitted by the light source that is included in the output light of the lighting device, the output light has a broad-spectrum composition of wavelengths approaching that of a blackbody radiator and accordingly characterized by a CRI value approaching 100.

The Table below provides some non-limiting examples of combinations of light sources and luminescent materials found to be suitable for producing white light in lighting devices such as those disclosed herein:

| Example | Light source | PL material |
|---|---|---|
| 1 | Blue LED, 450-460 nm | CdSe/ZnS core-shell QDs (Evident Technologies), particle diameter 2.6-3.2 nm, yellow emission, |
| 2 | Blue LED, 450-460 nm | CdSe/ZnSe core-shell QDs (Evident Technologies): particle diameter 2.4 nm, green emission; And particle diameter 5.2 nm, red emission |
| 3 | Violet LED, 408 nm | CdSe/ZnSe core-shell QDs (Evident Technologies) particle diameter 1.9 nm, blue emission; And particle diameter 2.4 nm, green emission; And particle diameter 5.2 nm, red emission |
| 4 | UV LED, 350-370 nm | CdSe/ZnSe core-shell QDs (Evident Technologies) particle diameter 1.9 nm, blue emission; And particle diameter 2.4 nm, green emission; And particle diameter 5.2 nm, red emission |
| 5 | Blue LED, 450-470 nm | Sulfoselenide phosphor (PhosphorTech Corp., Lithia Springs, GA), green emission; And Red-emitting QDs |
| 6 | Blue LED, 450-470 nm | Eu-doped silicate phosphor (Intematix Corp., Fremont, CA), green emission; And Red-emitting QDs |
| 7 | Blue LED, 450-470 nm | Ce-doped YAG phosphor (Intematix Corp., Fremont, CA), yellow emission; And Red-emitting QDs |

Various implementations and examples have been described above with an emphasis on typical consumer lighting applications. It will be understood, however, that the present subject matter may be applied to other kinds of lighting applications and further is not limited to use in the context of lighting devices. Other examples of applications include, but are not limited to, identification substrates in security devices, identification devices in military applications (e.g., authentication, identification of friend or foe), high efficiency light sources for bioreactors and green houses, etc.

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

For purposes of the present disclosure, it will be understood that when a layer (or film, region, substrate, component, device, or the like) is referred to as being "on" or "over" another layer, that layer may be directly or actually on (or over) the other layer or, alternatively, intervening layers (e.g., buffer layers, transition layers, interlayers, sacrificial layers, etch-stop layers, masks, electrodes, interconnects, contacts, or the like) may also be present. A layer that is "directly on" another layer means that no intervening layer is present, unless otherwise indicated. It will also be understood that when a layer is referred to as being "on" (or "over") another layer, that layer may cover the entire surface of the other layer or only a portion of the other layer. It will be further understood that terms such as "formed on" or "disposed on" are not intended to introduce any limitations relating to particular methods of material transport, deposition, fabrication, surface treatment, or physical, chemical, or ionic bonding or interaction. The term "interposed" is interpreted in a similar manner.

The following references contain subject matter related to the present subject matter, and each reference is incorporated by reference herein in its entirety: U.S. Patent Application Pub. No. 2005/0224998, filed on Apr. 8, 2004, titled "Electrospray/electrospinning Apparatus and Method," now issued as U.S. Pat. No. 7,762,801; U.S. Patent Application Pub. No. 2005/0224999, filed Apr. 8, 2004, titled "Electrospinning in a Controlled Gaseous Environment," now issued as U.S. Pat. No. 7,297,305; U.S. Patent Application Pub. No. 2006/0228435, filed on Apr. 8, 2004, titled "Electrospinning of Polymer Nanofibers Using a Rotating Spray Head," now issued as U.S. Pat. No. 7,134,857; U.S. Patent Application Pub. No. 2006/0264140, filed May 17, 2005 titled "Nanofiber Mats and Production Methods Thereof," now issued as U.S. Pat. No. 7,592,277; U.S. Patent Application Pub. No. 2008/0110342, filed Nov. 13, 2006, titled "Particle Filter System Incorporating Nanofibers," now issued as U.S. Pat. No. 7,789,930; U.S. Patent Application Pub. No. 2008/0113214, filed on Nov. 13, 2006, titled "Luminescent Device," now issued as U.S. Pat. No. 7,999,455; International Pub. No. WO 2009/032378, filed on Jun. 12, 2008, titled "Long-Pass Optical Filter Made from Nanofibers," also published as U.S. Patent Application Pub. No. 2010/0177518; U.S. Pat. No. 8,884,507, titled "Reflective Nanofiber Lighting Devices;" PCT Application No. PCT/US2010/031058, filed on Apr. 14, 2010, titled "Stimulated Lighting Devices," now issued as U.S. Pat. No. 8,851,693; U.S. Patent Application Pub. No. 2013/0215597, titled "Color-Tunable Lighting Devices and Methods for Tuning Color Output of Lighting Devices;" U.S. Patent Application Pub. No. 2013/0215599, titled "Lighting Devices With Color-Tuning Materials and Methods for Tuning Color Output of Lighting Devices;" and U.S. Patent Application Pub. No. 2013/0241435, titled "Lighting Devices Utilizing Optical Waveguide and Remote Light Converters, and Related Methods.".

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A photoluminescent nanofiber composite, comprising:

a substrate comprising a plurality of nanofibers and a substrate surface;

a plurality of first luminescent particles supported by the nanofibers and spanning at least a portion of the substrate surface, the first luminescent particles configured for emitting secondary light of a first wavelength in response to excitation by a light beam of a different wavelength; and one or more sections of second luminescent particles disposed on the substrate, the one or more sections comprising a pattern of deposition units spaced from each other, each deposition unit comprising a plurality of the second luminescent particles, the second luminescent particles configured for emitting secondary light at a second wavelength different from the primary wavelength and from the first wavelength, in response to excitation by the light beam.

2. The photoluminescent nanofiber composite of claim 1, wherein the one or more sections cover at least a portion of the first luminescent particles, or cover one or more exposed areas of the substrate surface.

3. The photoluminescent nanofiber composite of claim 1, wherein the plurality of first luminescent particles comprises a patterned layer, the patterned layer comprises one or more openings through which the substrate surface is exposed, and the one or more sections are disposed in respective openings.

4. The photoluminescent nanofiber composite of claim 1, wherein the substrate has a thickness ranging from 0.1 to 2,000 μm.

5. The photoluminescent nanofiber composite of claim 1, wherein the nanofibers have an average diameter ranging from 10 to 5,000 nm.

6. The photoluminescent nanofiber composite of claim 1, wherein the first luminescent particles are supported by the nanofibers in a configuration selected from the group consisting of: (a) the first luminescent particles supported on outside surfaces of the nanofibers; (b) the first luminescent particles at least partially embedded in the nanofibers; and (c) some first luminescent particles supported on outside surfaces of the nanofibers and other first luminescent particles at least partially embedded in the nanofibers.

7. The photoluminescent nanofiber composite of claim 1, wherein the first luminescent particles are arranged as one or more layers on the substrate surface.

8. The photoluminescent nanofiber composite of claim 1, wherein the first luminescent particles and the second luminescent particles are selected from the group consisting of quantum dots, phosphors, nano-phosphors, organic dyes, and combinations of two or more of the foregoing.

9. The photoluminescent nanofiber composite of claim 8, wherein the first luminescent particles are a different type of particle than the second luminescent particles.

10. The photoluminescent nanofiber composite of claim 8, wherein the first luminescent particles are the same type of particle as the second luminescent particles, and have a different composition, a different size, or a different composition and size than the second luminescent particles.

11. The photoluminescent nanofiber composite of claim 1, comprising a plurality of reflective particles disposed on the substrate surface in a configuration selected from the group consisting of: (a) the reflective particles arranged as a layer on the substrate surface; (b) the reflective particles mixed with the first luminescent particles; (c) the reflective particles arranged as a layer on the first luminescent particles; (d) the reflective particles mixed with the second luminescent particles; and (e) combinations of two or more of the foregoing.

12. The photoluminescent nanofiber composite of claim 1, wherein the deposition units have a shape selected from the group consisting of stripes, lines, circles, dots, ellipses, diamonds, polygons, and combinations of two or more of the foregoing.

13. The photoluminescent nanofiber composite of claim 1, wherein the layer of second luminescent particles comprises a plurality of sections of second luminescent particles forming a pattern with the first luminescent particles, and the pattern comprises alternating areas comprising first luminescent particles and second luminescent particles, respectively.

14. The photoluminescent nanofiber composite of claim 13, wherein the pattern of first luminescent particles and second luminescent particles is selected from the group consisting of a plurality of stripes, circles, dots, ellipses, polygons, circular sectors, spirals, and combinations of two or more of the foregoing.

15. The photoluminescent nanofiber composite of claim 1, wherein one or more of the sections comprise two or more layers of second luminescent particles.

16. The photoluminescent nanofiber composite of claim 1, wherein the one or more sections comprise a plurality of sections, and at least one section comprises a different number of layers of second luminescent particles than the other sections.

17. The photoluminescent nanofiber composite of claim 1, comprising a surface treatment coating disposed at a position selected from the group consisting of: (a) on the substrate surface, wherein the first luminescent particles are disposed on the surface treatment coating; (b) on the first luminescent particles, wherein the second luminescent particles are disposed on the surface treatment coating; and (c) on the substrate surface as a first surface treatment coating and on the first luminescent particles as a second surface treatment coating.

18. The photoluminescent nanofiber composite of claim 17, wherein the surface treatment coating comprises a composition selected from the group consisting of an adhesion promoter, a modifier of wetting properties, a modifier of resolution of the pattern of deposition units, and combinations of two or more of the foregoing.

19. The photoluminescent nanofiber composite of claim 17, wherein the surface treatment coating comprises a polyacrylate.

20. The photoluminescent nanofiber composite of claim 1, comprising an encapsulant encapsulating at least a portion of the photoluminescent nanofiber composite.

21. A lighting device, comprising:

a housing enclosing a housing interior and comprising a light exit for outputting a combination of primary light and secondary light;

a light source configured for emitting a primary light beam of a primary wavelength through the housing interior; and the photoluminescent nanofiber composite of claim 1 facing the housing interior.

22. A method for fabricating a photoluminescent nanofiber composite, the method comprising:

depositing a plurality of first luminescent particles on a nanofiber substrate such that the first luminescent particles are supported by the nanofibers and span at least a portion of a substrate surface of the substrate, the first luminescent particles configured for emitting secondary light of a first wavelength in response to excitation by a light beam of a different wavelength; and depositing a plurality of second luminescent particles as one or more sections on the substrate, the one or more sections comprising a pattern of deposition units spaced from each other, each deposition unit comprising a plurality of the second luminescent particles, the second luminescent particles configured for emitting secondary light at a second wavelength different from the primary wavelength and from the first wavelength, in response to excitation by the light beam.

23. The method of claim 22, wherein the one or more sections cover at least a portion of the first luminescent particles, or cover one or more exposed areas of the substrate surface.

24. The method of claim 22, wherein depositing the first or second luminescent particles comprises depositing a solution comprising the first or second luminescent particles and one or more solvents.

25. The method of claim 24, wherein the solution comprises an additive selected from the group consisting of a particle dispersant, a surfactant, a viscosifier, an agent that inhibits agglomeration, an agent that inhibits slumping, an agent that controls solution rheology, an agent that promotes adhesion, an agent that controls wetting properties, an agent that controls a resolution of the pattern of deposition units, and combinations of two of more of the foregoing.

26. The method of claim 22, wherein the first or second luminescent particles are deposited by a technique selected from the group consisting of ink-jet printing, digital printing, screen printing, thermal printing, transfer printing, spray coating, dip coating, drop coating, spin coating, electrospraying, doctor blading, Langmuir-Blodgett film formation, self-assembly of monolayers, and aerosol dry handling.

27. The method of claim 22, wherein depositing the first or second luminescent particles comprises operating a dispensing device to transport the first or second luminescent particles toward the substrate.

28. The method of claim 22, wherein depositing the second luminescent particles comprises operating a printing device, and further comprising controlling the pattern of deposition units by controlling the printing device.

29. The method of claim 22, wherein the second luminescent particles are deposited in one or more sections to form a pattern with the first luminescent particles, and the pattern comprises alternating areas comprising first luminescent particles and second luminescent particles, respectively.

30. The method of claim 22, comprising depositing a surface treatment coating at a position selected from the group consisting of: (a) on the substrate surface, wherein the first luminescent particles are deposited on the surface treatment coating; (b) on the first luminescent particles, wherein the second luminescent particles are deposited on the surface treatment coating; and (c) on the substrate surface as a first surface treatment coating and on the first luminescent particles as a second surface treatment coating.

31. A method for fabricating a photoluminescent nanofiber composite, the method comprising:

depositing one or more first layers of first luminescent particles on a surface of a nanofiber substrate such that the one or more first layers cover at least a portion of the surface, the first luminescent particles configured for emitting secondary light of a first wavelength in response to excitation by a light beam of a different wavelength; and depositing one or more second layers of second luminescent particles on the substrate, the second layer comprising a pattern of deposition units spaced from each other, each deposition unit comprising a plurality of the second luminescent particles, the second luminescent particles configured for emitting secondary light at a second wavelength different from the primary wavelength and from the first wavelength, in response to excitation by the light beam.

32. The method of claim 31, comprising depositing a surface treatment coating at a position selected from the group consisting of: (a) on the substrate surface, wherein the first layer is deposited on the surface treatment coating; (b) on the first layer, wherein the layer is deposited on the surface treatment coating; and (c) on the substrate surface as a first surface treatment coating and on the first layer as a second surface treatment coating.

* * * * *